US011618537B2

(12) United States Patent
Schmid et al.

(10) Patent No.: US 11,618,537 B2
(45) Date of Patent: Apr. 4, 2023

(54) SYSTEM AND METHOD FOR POSITIONING AN AQUATIC VESSEL

(71) Applicant: Polaris Industries Inc., Medina, MN (US)

(72) Inventors: Andrew C. Schmid, Brooklyn Park, MN (US); Katie C. Kirchner, Blaine, MN (US); Michael F. Donoughe, Rochester, MI (US); Jeremy C. Smith, Shafer, MN (US); Blair A. Donat, Elkhart, IN (US); Gabriel A. Marshall, Three Rivers, MI (US); Bradley R. Fishburn, Nappanee, IN (US)

(73) Assignee: Polaris Industries Inc., Medina, MN (US)

( * ) Notice: Subject to any disclaimer, the term of this patent is extended or adjusted under 35 U.S.C. 154(b) by 208 days.

(21) Appl. No.: 17/032,300

(22) Filed: Sep. 25, 2020

(65) Prior Publication Data

US 2021/0094661 A1 Apr. 1, 2021

Related U.S. Application Data

(60) Provisional application No. 62/907,366, filed on Sep. 27, 2019.

(51) Int. Cl.

| | |
|---|---|
| ***B63B 79/10*** | (2020.01) |
| ***B63B 35/34*** | (2006.01) |
| ***B63B 3/48*** | (2006.01) |
| ***B63B 1/12*** | (2006.01) |
| ***B63H 20/08*** | (2006.01) |

(Continued)

(52) U.S. Cl.

CPC ..... *B63B 79/10* (2020.01); *B63B 1/125* (2013.01); *B63B 3/48* (2013.01); *B63B 35/34* (2013.01); *B63B 79/40* (2020.01); *B63H 11/04* (2013.01); *B63H 20/08* (2013.01)

(58) Field of Classification Search

CPC ..... B63B 79/40; B63B 79/10; B63B 1/125; B63B 3/48; B63B 35/44; B63H 11/04; B63H 20/08

See application file for complete search history.

(56) References Cited

U.S. PATENT DOCUMENTS

| | | | |
|---|---|---|---|
| 5,172,324 | A | 12/1992 | Knight |
| 5,259,331 | A | 11/1993 | Hagan |
| 6,439,941 | B2 | 8/2002 | McClure |

(Continued)

FOREIGN PATENT DOCUMENTS

| | | |
|---|---|---|
| JP | H0747992 | 2/1995 |
| KR | 10-2016-0006943 | 1/2016 |

(Continued)

OTHER PUBLICATIONS

International Search Report and Written Opinion, issued by the International Searching Authority, dated Dec. 21, 2020, for International Patent Application No. 3; 9 pages.

(Continued)

*Primary Examiner* — Stephen P Avila

(74) *Attorney, Agent, or Firm* — Faegre Drinker Biddle & Reath LLP

(57) ABSTRACT

A pontoon boat including a thruster system is disclosed. The pontoon boat executes various operations relating to a speed and heading of the pontoon boat.

51 Claims, 14 Drawing Sheets

(51) Int. Cl.
*B63H 11/04* (2006.01)
*B63B 79/40* (2020.01)

(56) References Cited

U.S. PATENT DOCUMENTS

| | | | | |
|---|---|---|---|---|
| 6,469,664 | B1 | 10/2002 | Michaelson | |
| 6,581,537 | B2 | 6/2003 | McBride | |
| 6,734,808 | B1 | 5/2004 | Michaelson | |
| 7,182,033 | B1 | 2/2007 | Phillips | |
| 7,185,599 | B1 | 3/2007 | Griffiths | |
| 7,416,458 | B2 | 8/2008 | Suemori | |
| 8,622,778 | B2 | 1/2014 | Tyers | |
| 8,645,012 | B2 | 2/2014 | Salmon | |
| 9,108,710 | B1 | 8/2015 | McChesney | |
| 9,738,364 | B2 | 8/2017 | Abney | |
| 9,778,657 | B2 * | 10/2017 | Tyers | B63H 25/04 |
| 10,272,977 | B2 | 4/2019 | Hashizume | |
| 10,281,917 | B2 | 5/2019 | Tyers | |
| 11,390,262 | B2 | 7/2022 | Brandt | |
| 2005/0272322 | A1 | 12/2005 | Mizuguchi | |
| 2006/0228959 | A1 | 10/2006 | Ruiz | |
| 2012/0129410 | A1 | 5/2012 | Tyers | |
| 2017/0205829 | A1 | 7/2017 | Tyers | |
| 2018/0283874 | A1 * | 10/2018 | Hashizume | G09B 29/007 |
| 2018/0286251 | A1 | 10/2018 | Fujima | |
| 2020/0385097 | A1 | 12/2020 | Fishburn | |

FOREIGN PATENT DOCUMENTS

| | | |
|---|---|---|
| WO | 2016/166620 | 10/2016 |
| WO | 2019/081019 | 5/2019 |

OTHER PUBLICATIONS

Hummingbird.com, 2019 Hummingbird Products brochure; 40 pages.
Faria Marine Instruments Owner's Manual; 4 pages, Nov. 2003.
"Evinrude unveils $5,999 iDock joystick piloting system", Jul. 10, 2017; 4 pages.

* cited by examiner

SYSTEM AND METHOD FOR POSITIONING AN AQUATIC VESSEL

RELATED APPLICATION

This application claims the benefit of U.S. Patent Application No. 62/907,366, filed Sep. 27, 2019, titled SYSTEM AND METHOD FOR POSITIONING AN AQUATIC VESSEL, the entire disclosure of which is expressly incorporated by reference herein.

FIELD

The present disclosure relates to systems and methods to change position of an aquatic vessel and in particular an automatic system for changing a position of an aquatic vessel.

BACKGROUND

Systems, like the LAKEMASTER system from Humminbird, are known that provide contour maps of bodies of water. Further, systems, like the I-PILOT system from Humminbird, provides a follow mode, an I-TRACKS mode, spot-lock mode, and go to waypoint mode. In the follow mode, the system will automatically move the boat on a depth contour, bottom hardness, or vegetation line. In the I-TRACKS mode, the system stores routes in the water (up to 2 miles long) and is capable of retracing those routes. The user can select a stored route and the system will maneuver the boat to the closest point of the selected track. In the spot-lock mode, the system maintains the boat in a given location. In the go to waypoint mode, a waypoint is selected and the system maneuvers the boat to the selected waypoint.

A need exists for systems that provide greater control over the movement of an aquatic vessel, such as a boat, in the water and relative to environmental objects.

SUMMARY

In an exemplary embodiment of the present disclosure, a pontoon boat is provided. The pontoon boat comprising a plurality of pontoons; a deck supported by the plurality of pontoons, the deck having an outer perimeter; a plurality of sensors supported by the plurality of pontoons; a propulsion system having at least one prime mover which propels the pontoon boat through the water; and at least one controller operatively coupled to the plurality of sensors and the at least one prime mover. The at least one controller configured to monitor a location of the pontoon boat and determine a relationship of the pontoon boat to a boundary in the water. The pontoon boat capable of navigating on both a first side of the boundary and a second side of the boundary. The second side of the boundary opposite the first side of the boundary.

In an example, the at least one controller is further configured to control the propulsion system to maintain the pontoon boat on a first side of the boundary.

In another example, the pontoon boat further comprising at least one memory including a plurality of operator profiles. A first operator profile includes the boundary and a second operator profile does not include the boundary. The at least one controller is further configured to determine which operator profile is currently associated with the pontoon boat and, if the second operator profile is associated with the pontoon boat, the at least one controller permits the pontoon boat to cross the boundary.

In a further example, the pontoon boat further comprising a locator operatively coupled to the at least one controller. The locator providing an indication of the location of the pontoon boat to the at least one controller.

In yet another example, the plurality of sensors includes at least one sensor monitoring an above water region proximate the pontoon boat. The at least one controller is operatively coupled to the at least one sensor to determine a position of an environmental object proximate the pontoon boat and to control the propulsion system to avoid contact with the environmental object.

In yet a further example, the plurality of pontoons includes a port side pontoon, a starboard side pontoon, and a third pontoon positioned between the port side pontoon and the starboard side pontoon, each of the plurality of pontoons extending longitudinally under the deck.

In still another example, the propulsion system includes an outboard motor positioned at a stern of the deck of the pontoon boat.

In yet still another example, the propulsion system includes a thruster system including at least one water inlet in the plurality of pontoons and a plurality of water outlets in the plurality of pontoons. In a variation thereof, the at least one water inlet and the plurality of water outlets are provided in the third pontoon. In another variation thereof, the plurality of water outlets includes at least two of a port-bow outlet, a port-stern outlet, a starboard-bow outlet, and a starboard-stern outlet. In still another variation, the thruster system further includes at least one fluid pump which pumps fluid from the at least one inlet towards at least one of the plurality of outlets.

In yet a further example, the pontoon boat further comprising a warning device operably coupled to the at least one controller, the at least one controller causing the warning device to announce a warning in response to the location of the pontoon boat approaching within a first distance of the boundary. In a variation thereof, the warning device provides at least one of an audible warning, a visual warning, and a tactile warning.

In another exemplary embodiment of the present disclosure, a method of controlling a position of a pontoon boat relative to a boundary is provided. The method comprising the steps of: monitoring a location of the pontoon boat with at least one controller associated with the pontoon boat; determining a relationship of the pontoon boat to a boundary in the water with the at least one controller associated with the pontoon boat, the pontoon boat capable of navigating on both a first side of the boundary and a second side of the boundary; and in response to the location of the pontoon boat approaching within a first distance of the boundary, with the at least one controller associated with the pontoon boat, providing a warning to an operator of the pontoon boat.

In an example thereof, the method further comprising in response to the location of the pontoon boat approaching within the first distance of the boundary automatically controlling, with the at least one controller associated with the pontoon boat, the propulsion system to maintain the pontoon boat on the first side of the boundary. In a variation thereof, the step of automatically controlling, with the at least one controller associated with the pontoon boat, the propulsion system to maintain the pontoon boat on the first side of the boundary includes the step of altering the position of the pontoon boat with a thruster system carried by at least one of the plurality of pontoons.

In another example, the method further comprising the step of receiving a user input of at least two positions which influence a shape of at least a portion of the boundary.

In a further exemplary embodiment of the present disclosure, a method of controlling a position of a pontoon boat relative to a boundary is provided. The method comprising the steps of: monitoring a location of the pontoon boat with at least one controller associated with the pontoon boat; determining a relationship of the pontoon boat to a boundary in the water with the at least one controller associated with the pontoon boat, the pontoon boat capable of navigating on both a first side of the boundary and a second side of the boundary; and in response to the location of the pontoon boat approaching within a first distance of the boundary automatically controlling, with the at least one controller associated with the pontoon boat, the propulsion system to maintain the pontoon boat on the first side of the boundary.

In an example thereof, the step of automatically controlling, with the at least one controller associated with the pontoon boat, the propulsion system to maintain the pontoon boat on the first side of the boundary includes the step of altering the position of the pontoon boat with a thruster system carried by at least one of the plurality of pontoons.

In another example thereof, the method further comprising the step of receiving a user input of at least two positions which influence a shape of at least a portion of the boundary.

In a yet further exemplary embodiment of the present disclosure, a pontoon boat for navigating through water having a plurality of environmental objects is provided. The pontoon boat comprising a plurality of pontoons; a deck supported by the plurality of pontoons, the deck having an outer perimeter; a plurality of sensors supported by the plurality of pontoons; a propulsion system having at least one prime mover which propels the pontoon boat through the water; and at least one controller operatively coupled to the plurality of sensors and the at least one prime mover. The at least one controller configured to monitor a location of the pontoon boat and to determine a relationship of the pontoon boat to a location of a first environmental object of the plurality of environmental objects in the water, and automatically controlling the propulsion system to avoid the first environmental object, the first environmental object being an underwater environmental object.

In an example thereof, the location of the first environmental object is determined by the at least one controller from a map of the water.

In another example thereof, the location of the first environmental object is determined by the at least one controller based on an output from at least one sensor of the plurality of sensors.

In a further example thereof, the pontoon boat further comprising a locator operatively coupled to the at least one controller, the locator providing an indication of the location of the pontoon boat to the at least one controller.

In a yet further example, the plurality of sensors includes at least one sensor monitoring an above water region proximate the pontoon boat, wherein the at least one controller is operatively coupled to the at least one sensor to determine a position of a second environmental object of the plurality of environmental objects proximate the pontoon boat and to control the propulsion system to avoid contact with the second environmental object of the plurality of environmental objects.

In a still further example, the plurality of pontoons includes a port side pontoon, a starboard side pontoon, and a third pontoon positioned between the port side pontoon and the starboard side pontoon, each of the plurality of pontoons extending longitudinally under the deck.

In a further still example, the propulsion system includes an outboard motor positioned at a stern of the deck of the pontoon boat.

In a yet further still example, the propulsion system includes a thruster system including at least one water inlet in the plurality of pontoons and a plurality of water outlets in the plurality of pontoons. In a variation thereof, the at least one water inlet and the plurality of water outlets are provided in the third pontoon. In another variation thereof, the plurality of water outlets includes at least two of a port-bow outlet, a port-stern outlet, a starboard-bow outlet, and a starboard-stern outlet. In still another variation thereof, the thruster system further includes at least one fluid pump which pumps fluid from the at least one inlet towards at least one of the plurality of outlets.

In another still example, the pontoon boat further comprising a warning device operably coupled to the at least one controller, the at least one controller causing the warning device to announce a warning in response to the location of the pontoon boat approaching within a first distance of the first environmental object. In a variation thereof, the warning device provides at least one of an audible warning, a visual warning, and a tactile warning.

In yet another exemplary embodiment of the present disclosure, a pontoon boat for navigating through water having a plurality of environmental objects is provided. The pontoon boat comprising: a plurality of pontoons; a deck supported by the plurality of pontoons, the deck having an outer perimeter; a propulsion system having at least one prime mover which propels the pontoon boat through the water; at least one controller operatively coupled to the at least one prime mover; and a memory accessible by the at least one controller. The memory including a current profile associated with the pontoon boat, the at least one controller configured to operate the pontoon boat based on the current profile associated with the pontoon boat.

In an example thereof, the at least one controller controls the propulsion system based on the current profile associated with the pontoon boat.

In another example thereof, the current profile limits the pontoon boat from crossing a boundary in the water, the pontoon boat capable of navigating on both a first side of the boundary and a second side of the boundary, the second side of the boundary opposite the first side of the boundary.

In a further example thereof, the current profile is a user profile. In a variation thereof, the current profile is selected from a plurality of profiles stored on the memory. In another variation thereof, the current profile is communicated to the pontoon boat from a portable operator device. In still another variation thereof, the current profile is a valet profile and the controller is configured to automatically dock the pontoon boat when the current profile is a valet profile.

In yet a further example, the current profile is a boat profile, the boat profile specifying a level of the propulsion system. In a variation thereof, a first level of the propulsion system includes a single outboard motor. In another variation thereof, a second level of the propulsion system includes multiple outboard motors. In yet another variation thereof, a third level of the propulsion systems includes a thruster system including at least one water inlet in the plurality of pontoons and a plurality of water outlets in the plurality of pontoons.

In another still exemplary embodiment of the present disclosure, a pontoon boat is provided. The pontoon boat comprising: a plurality of pontoons; a deck supported by the plurality of pontoons, the deck having an outer perimeter; a plurality of sensors supported by the plurality of pontoons;

a propulsion system having at least one prime mover which propels the pontoon boat through the water, the at least one prime mover including a thruster system including at least one water inlet in the plurality of pontoons, a plurality of water outlets in the plurality of pontoons, and at least one fluid pump which pumps fluid from the at least one inlet towards at least one of the plurality of outlets; at least one controller operatively coupled to the plurality of sensors and the at least one prime mover; and a memory accessible by the at least one controller and at least one stored predefined route for the pontoon boat. The at least one controller configured to monitor a location of the pontoon boat and to move the pontoon boat according to the predefined route stored on the memory.

In an example thereof, the plurality of sensors includes at least one sensor monitoring an above water region proximate the pontoon boat. The at least one controller is operatively coupled to the at least one sensor to determine a position of an environmental object proximate the pontoon boat and to control the propulsion system to avoid contact with the environmental object.

In another example thereof, the plurality of pontoons includes a port side pontoon, a starboard side pontoon, and a third pontoon positioned between the port side pontoon and the starboard side pontoon, each of the plurality of pontoons extending longitudinally under the deck, wherein the at least one water inlet and the plurality of water outlets are provided in the third pontoon.

In yet another example thereof, the plurality of water outlets includes at least two of a port-bow outlet, a port-stern outlet, a starboard-bow outlet, and a starboard-stern outlet.

In still another example, the plurality of sensors includes a tow sensor which provides an indication of a characteristic of a tow line.

BRIEF DESCRIPTION OF THE DRAWINGS

The above-mentioned and other features and advantages of this disclosure, and the manner of attaining them, will become more apparent and will be better understood by reference to the following description of exemplary embodiments taken in conjunction with the accompanying drawings, wherein.

Corresponding reference characters indicate corresponding parts throughout the several views. The exemplification set out herein illustrates an exemplary embodiment of the invention and such exemplification is not to be construed as limiting the scope of the invention in any manner.

DETAILED DESCRIPTION OF THE DRAWINGS

Figure 1:
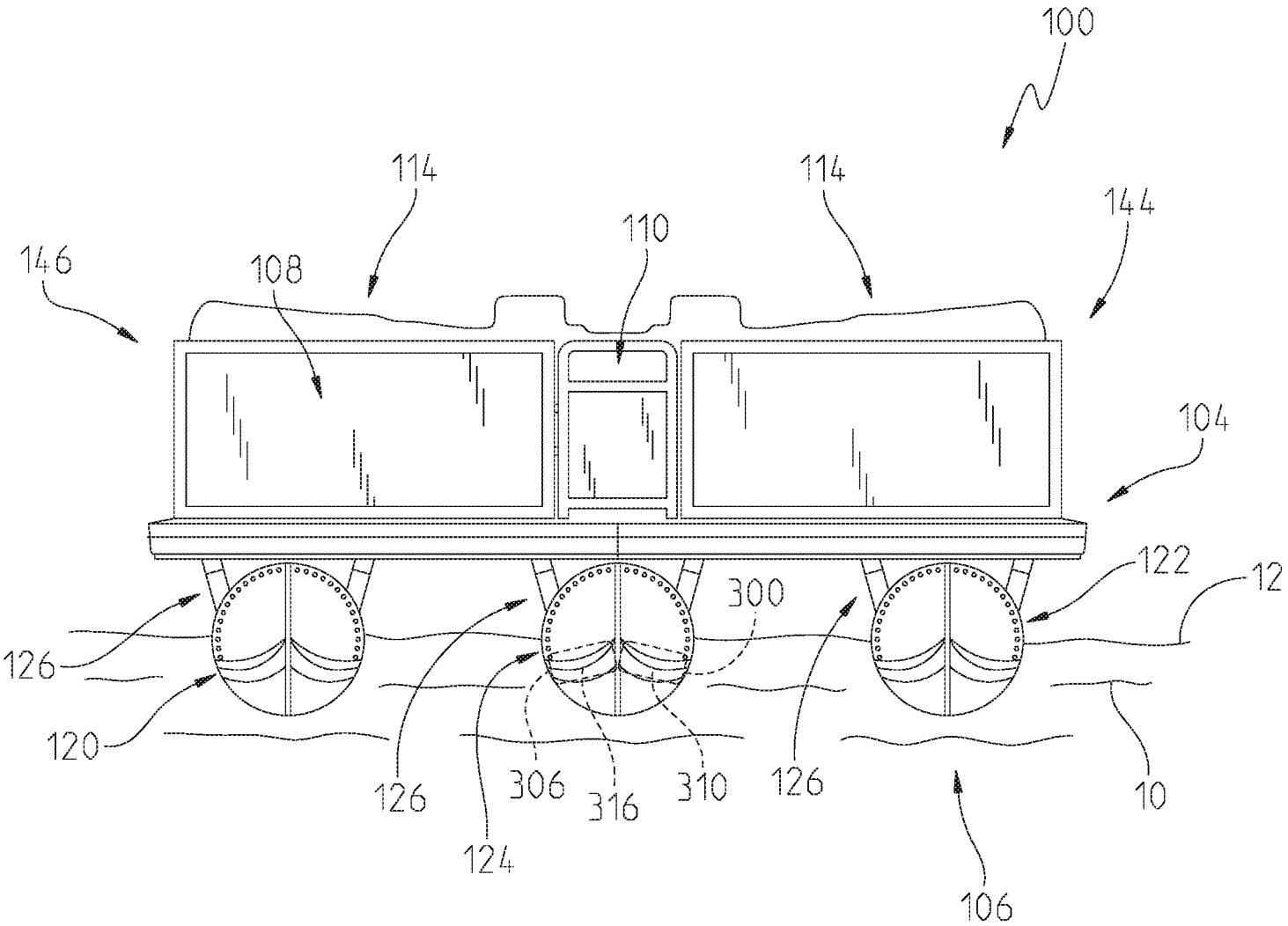
FIG. 1 illustrates a front view of a pontoon boat having a deck supported by a plurality of pontoons.

For the purposes of promoting an understanding of the principles of the present disclosure, reference is now made to the embodiments illustrated in the drawings, which are described below. The embodiments disclosed herein are not intended to be exhaustive or limit the present disclosure to the precise form disclosed in the following detailed description. Rather, the embodiments are chosen and described so that others skilled in the art may utilize their teachings. Therefore, no limitation of the scope of the present disclosure is thereby intended. Corresponding reference characters indicate corresponding parts throughout the several views.

The terms "couples", "coupled", "coupler" and variations thereof are used to include both arrangements wherein the two or more components are in direct physical contact and arrangements wherein the two or more components are not in direct contact with each other (e.g., the components are "coupled" via at least a third component), but yet still cooperate or interact with each other.

In some instances throughout this disclosure and in the claims, numeric terminology, such as first, second, third, and fourth, is used in reference to various components or features. Such use is not intended to denote an ordering of the components or features. Rather, numeric terminology is used to assist the reader in identifying the component or features being referenced and should not be narrowly interpreted as providing a specific order of components or features.

The embodiments disclosed herein may be used with any type of aquatic vessel, including pontoon boats, single hull boats, and other types of aquatic vessels. An exemplary aquatic vessel, a pontoon boat 100 is provided as an example.

Referring to FIG. 1, an exemplary pontoon boat 100 is floating in a body of water 10 having a top surface 12. Pontoon boat 100 includes a deck 104 supported by a plurality of pontoons 106. The deck supports a railing 108 including a gate 110 positioned in a bow portion 112 (see FIG. 2) of pontoon boat 100. Pontoon boat 100 may further include a plurality of seats 114, a canopy (not shown), and other components supported by deck 104.

Figure 2:
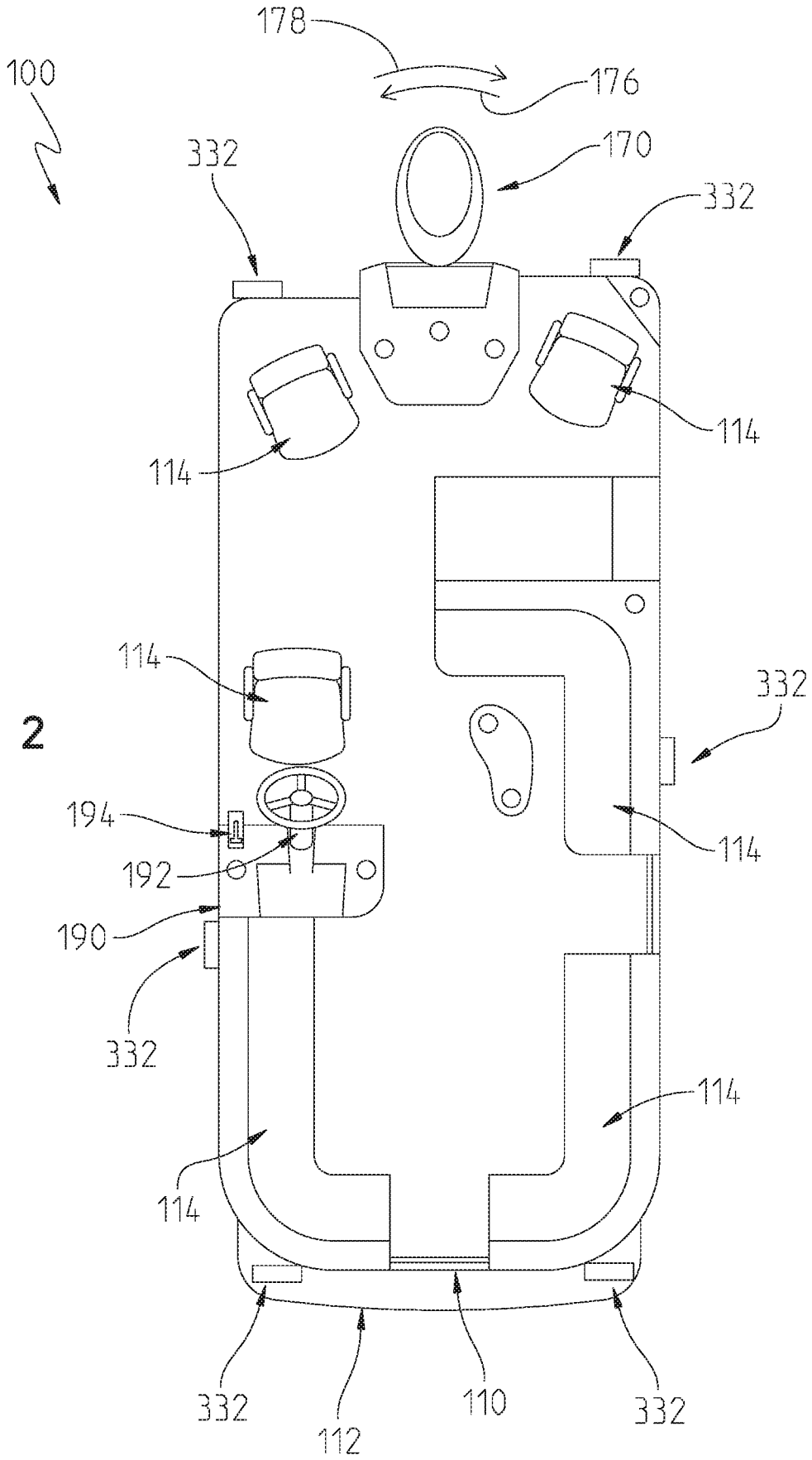
FIG. 2 illustrates a top view of a pontoon boat having a deck and seating.

Referring to FIG. 2, one contemplated arrangement of seating 114 on deck 104 is illustrated. Other arrangements are also contemplated. As shown in FIG. 2, pontoon boat 100 further includes an operator console 190 having a plurality of operator controls including a steering input, illustratively steering wheel 192, and a throttle control, illustratively a throttle lever 194, and other exemplary controls.

Returning to FIG. 1, the plurality of pontoons 106 include a starboard pontoon 120, a port pontoon 122, and a central pontoon 124. Each of starboard pontoon 120, port pontoon 122, and central pontoon 124 support deck 104 through respective brackets 126. Each of starboard pontoon 120, port pontoon 122, and central pontoon 124 support deck 104 above top surface 12 of water 10. Although three pontoons are illustrated, the plurality of pontoons 106 may be limited to two pontoons or have four or more pontoons. Further, the thruster systems described herein may be used with other types of aquatic vessels, such as a single hull vessel.

Figure 3:
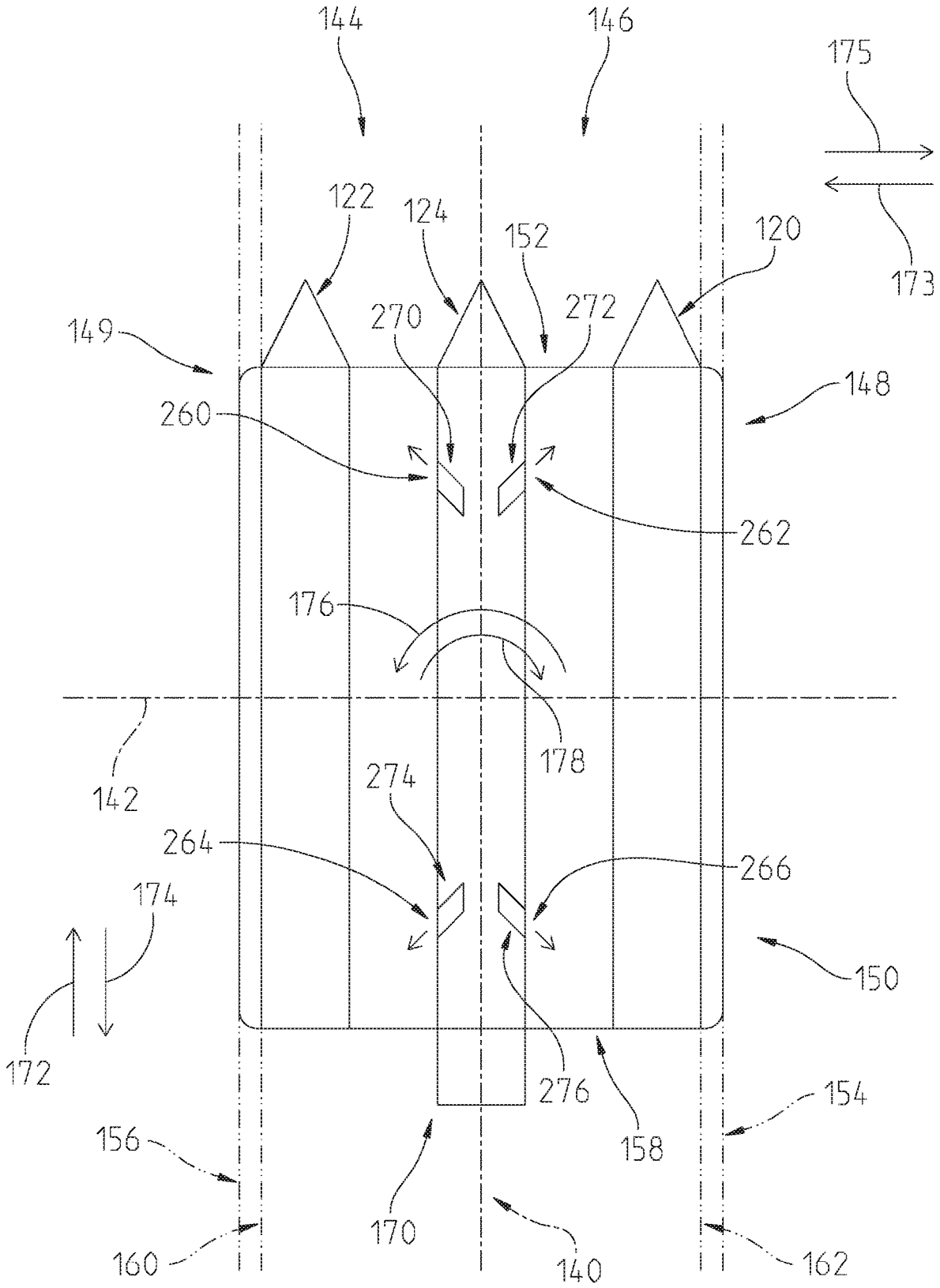
FIG. 3 illustrates a representative top view of the pontoon boat of FIG. 1 including a thruster system having a first group of thruster outlets positioned in a bow portion of the pontoon boat and directed towards the bow of the pontoon boat with a first one directed towards port and a second one directed towards starboard and a second group of thruster outlets positioned in a stern portion of the pontoon boat and directed towards the stern of the pontoon boat with a first one directed towards port and a second one directed towards starboard.

Referring to FIG. 3, pontoon boat 100 has a longitudinal centerline 140 and a lateral centerline 142. Longitudinal centerline 140 divides pontoon boat 100 into a port side 144 of pontoon boat 100 and a starboard side 146 of pontoon boat 100. Lateral centerline 142 divides pontoon boat 100 into a bow portion 148 of pontoon boat 100 and a stern portion 150 of pontoon boat 100. Deck 104 of pontoon boat 100 includes an outer perimeter 149 including a bow perimeter portion 152, a starboard perimeter portion 154, a stern perimeter portion 158, and a port perimeter portion 156. The plurality of pontoons 106 define a port extreme extent 160 corresponding to an outer extent of port pontoon 122 and a starboard extreme extent 162 corresponding to an outer extent of starboard pontoon 120.

Pontoon boat 100 includes an outboard motor 170 which extends beyond stern perimeter portion 158 of deck 104. In embodiments, outboard motor 170 is an internal combustion engine which powers rotation of a propeller (not shown). The propeller may be rotated in a first direction to propel pontoon boat 100 forward in a direction 172 or in a second direction to propel pontoon boat 100 rearward in a direction 174. In embodiments, outboard motor 170 is rotatably mounted relative to deck 104 such that an orientation of the propeller may be adjusted to turn pontoon boat 100 in one of direction 176 and direction 178. In embodiments, multiple outboard motors 170 may be provided. In one example, the multiple outboard motors 170 may be positioned adjacent the stern perimeter portion 158 of pontoon boat 100. Although the illustrated embodiment is an outboard motor 170, motor 170 may also be an inboard motor positioned at least partially within perimeter 149 of pontoon boat 100.

Figure 4:
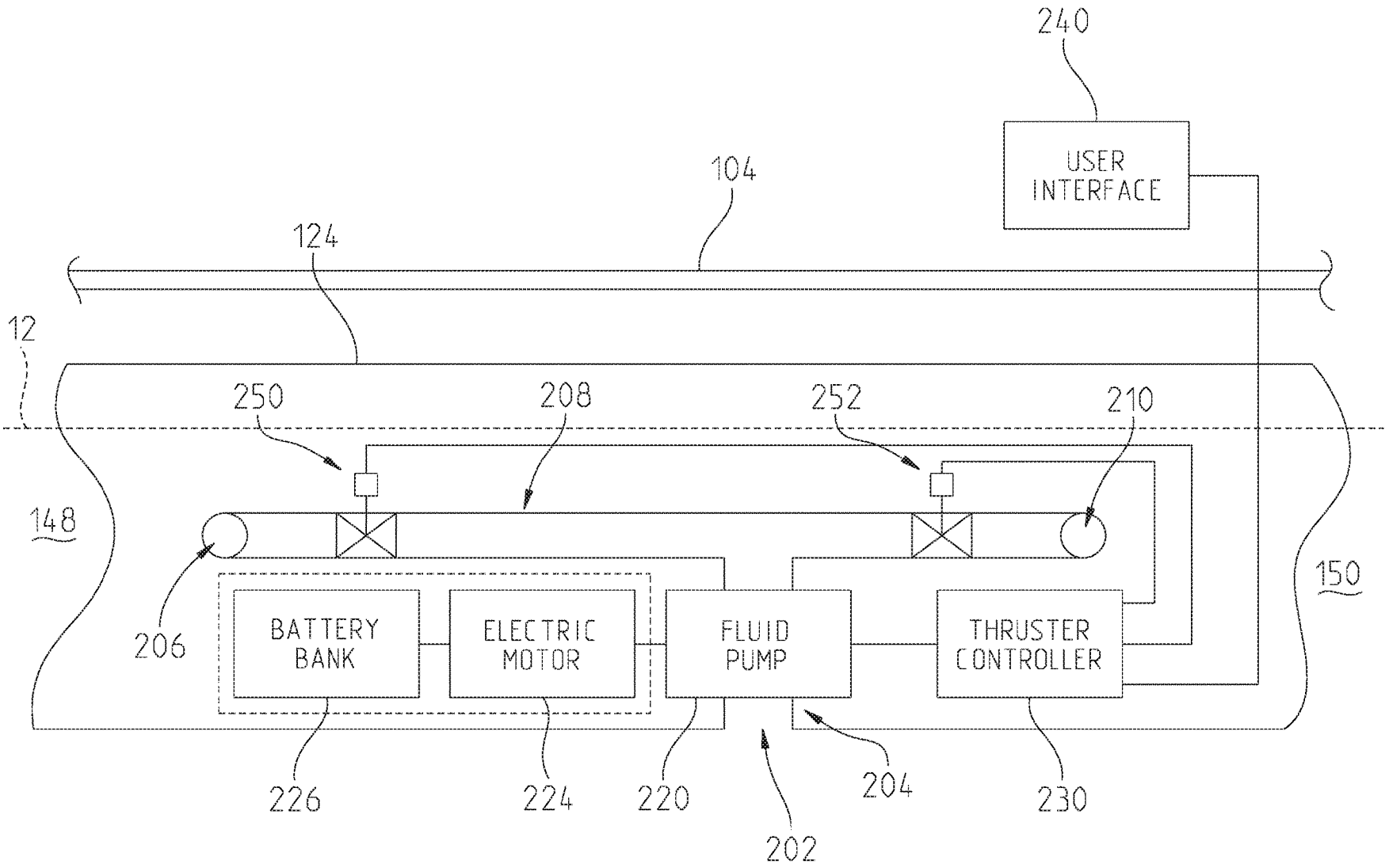
FIG. 4 illustrates a representative view of a portion of one of the plurality of pontoons of FIG. 1 including a thruster system.

Referring to FIG. 4, pontoon boat 100 further includes a thruster system 200. Thruster system 200 provides additional control over a position and/or orientation of pontoon boat 100. Thruster system 200 may carried by one or more of the plurality of pontoons 106. In embodiments, thruster system 200 is carried by central pontoon 124 or a combination of any one or more of starboard pontoon 120, port pontoon 122, and central pontoon 124. Thruster system 200 may be internal to one or more of the plurality of pontoons 106, external to the one or more plurality of pontoons, or a combination thereof. In embodiments, at least one of the plurality of pontoons 106, illustratively central pontoon 124, includes at least one water inlet, illustratively water inlet 202 of fluid conduit 204 is shown, and at least one water outlet, illustratively water outlet 206 and water outlet 210 both of fluid conduit 208, are shown. Fluid conduit 208 is fluidly coupled to fluid conduit 204. As shown in FIG. 2, each of water inlet 202, water outlet 206, and water outlet 210 are positioned below top surface 12 of water 10.

Thruster system 200 includes a fluid pump 220 positioned in fluid conduit 204 to move water from proximate water inlet 202 of fluid conduit 204 towards water outlet 206 and water outlet 210 of fluid conduit 208. Exemplary fluid pumps include the JT-30, JT-50, JT-70, and JT-90 series pumps available from Holland Marine Parts B. V. located at Donker Duyvisweg 297, 3316 BL Dordrecht (NL). Fluid pump 220 is powered by a power source 222. Illustratively power source 222 includes an electric motor 224 and a battery bank 226 which power electric motor 224.

The operation of fluid pump 220 is controlled with a controller 230. In embodiments, controller 230 is an electronic controller including processing circuits and memory. In embodiments, controller 230 is microprocessor-based and memory is a non-transitory computer readable medium which includes processing instructions stored therein that are executable by the microprocessor of controller to control operation of fluid pump 220. Exemplary non-transitory computer-readable mediums include random access memory (RAM), read-only memory (ROM), erasable programmable read-only memory (e.g., EPROM, EEPROM, or Flash memory), or any other tangible medium capable of storing information.

In embodiments, controller 230 is one of wired or wirelessly coupled to a user interface 240, such as operator console 190 (see FIG. 2), positioned above deck 104. User interface 240 includes one or more input devices. Exemplary input devices include switches, dials, joysticks, touch screens, and other suitable input devices for receiving a user input. In embodiments, the user interface is provided on a personal mobile device, such as a smart phone or tablet (see for example remote operator device 300 in FIG. 5B), and the personal mobile device includes processing instructions which provide input to controller 230 over a wireless connection.

As shown in FIG. 4, in embodiments, controller 230 is also operatively coupled to a first valve 250 and a second valve 252. Controller 230 controls whether fluid from fluid pump 220 reaches water outlet 206 based on whether first valve 250 is open or closed by controller 230. Controller 230 controls whether fluid from fluid pump 220 reaches water outlet 210 based on whether second valve 252 is open or closed by controller 230. In embodiments, controller 230 may control additional valves to control fluid flow to additional water outlets. In embodiments, thruster system 200 does not include valves 250 and 252. Rather, in one embodiment, fluid pump 220 is fluidly coupled to only water inlet 202 and water outlet 206 and a separate fluid pump 220 is provided to fluidly couple water inlet 202 and water outlet 210.

Returning to FIG. 3, an embodiment of thruster system 200 is illustrated. In FIG. 3, thruster system 200 includes four water outlets, a bow-port outlet 260, a bow-starboard outlet 262, a stern-port outlet 264, and a stern-starboard outlet 266. Bow-port outlet 260 has a corresponding fluid conduit 270 which causes water to exit bow-port outlet 260 in a direction, indicated by the arrow, towards both port side 144 of pontoon boat 100 and bow portion 148 of pontoon boat 100. Bow-starboard outlet 262 has a corresponding fluid conduit 272 which causes water to exit bow-starboard outlet 262 in a direction, indicated by the arrow, towards both starboard side 146 of pontoon boat 100 and bow portion 148 of pontoon boat 100. Stern-port outlet 264 has a corresponding fluid conduit 274 which causes water to exit stern-port outlet 264 in a direction, indicated by the arrow, towards both port side 144 of pontoon boat 100 and stern portion 150 of pontoon boat 100. Stern-starboard outlet 266 has a corresponding fluid conduit 276 which causes water to exit stern-starboard outlet 266 in a direction, indicated by the arrow, towards both starboard side 146 of pontoon boat 100 and stern portion 150 of pontoon boat 100. In embodiments, the direction of outlet 260 is straight towards port side 144 to cause water to exit in a direction towards port side 144 of pontoon boat 100 or angled to cause water to exit in a direction towards both port side 144 of pontoon boat 100 and stern portion 150 of pontoon boat 100, the direction of outlet 262 is straight towards starboard side 146 to cause water to exit in a direction towards starboard side 146 of pontoon boat 100 or angled to cause water to exit in a direction towards both starboard side 146 of pontoon boat 100 and stern portion 150 of pontoon boat 100, the direction of outlet 264 is straight towards port side 144 to cause water to exit in a direction towards port side 144 of pontoon boat 100 or angled to cause water to exit in a direction towards both port side 144 of pontoon boat 100 and bow portion 148 of pontoon boat 100, and/or the direction of outlet 266 is straight towards starboard side 146 to cause water to exit in a direction towards starboard side 146 of pontoon boat 100 or angled to cause water to exit in a direction towards both starboard side 146 of pontoon boat 100 and bow portion 148 of pontoon boat 100.

In embodiments, each of fluid conduits 270-276 are angled downward (see FIG. 1) so that water exiting the respective outlets 260-266 is directed downward, as opposed to straight horizontally. An advantage, among others, of angling the outlets 260-266 of fluid conduits 270-276 downward is increased stability of pontoon boat 100 in water 10. In embodiments, the outlets 260-266 of fluid conduits 270-276 of the depicted thrusters, and/or the outlets of fluid conduits of additional thrusters may be oriented horizontally, angled upward, angled downward or combinations thereof. In embodiments, the outlet direction of fluid conduits 270-276 and/or of additional fluid conduits is adjustable in at least one of vertically (e.g. upward, straight horizontally, and downward) and fore-aft (e.g. more towards bow portion 148, straight laterally towards one of port portion 144 and starboard portion 146, and more towards stern portion 150).

In embodiments, each of fluid conduit 270, fluid conduit 272, fluid conduit 274, and fluid conduit 276 are fed by a respective fluid pump 220 from one or more water inlets 202 in central pontoon 124. In embodiments, a plurality of fluid conduit 270, fluid conduit 272, fluid conduit 274, and fluid conduit 276 are fed by a common fluid pump 220 and one or more valves are included to control which of the plurality of fluid conduit 270, fluid conduit 272, fluid conduit 274, and fluid conduit 276 are in fluid communication with the common fluid pump 220.

Additional details regarding exemplary thruster systems and operator inputs are provided in U.S. Provisional Patent Application Ser. No. 62/859,507, filed Jun. 10, 2019, titled THRUSTER ARRANGEMENT FOR A BOAT, ("Thruster Provisional Application"), the entire disclosure of which is expressly incorporated by reference herein.

Figure 5A:
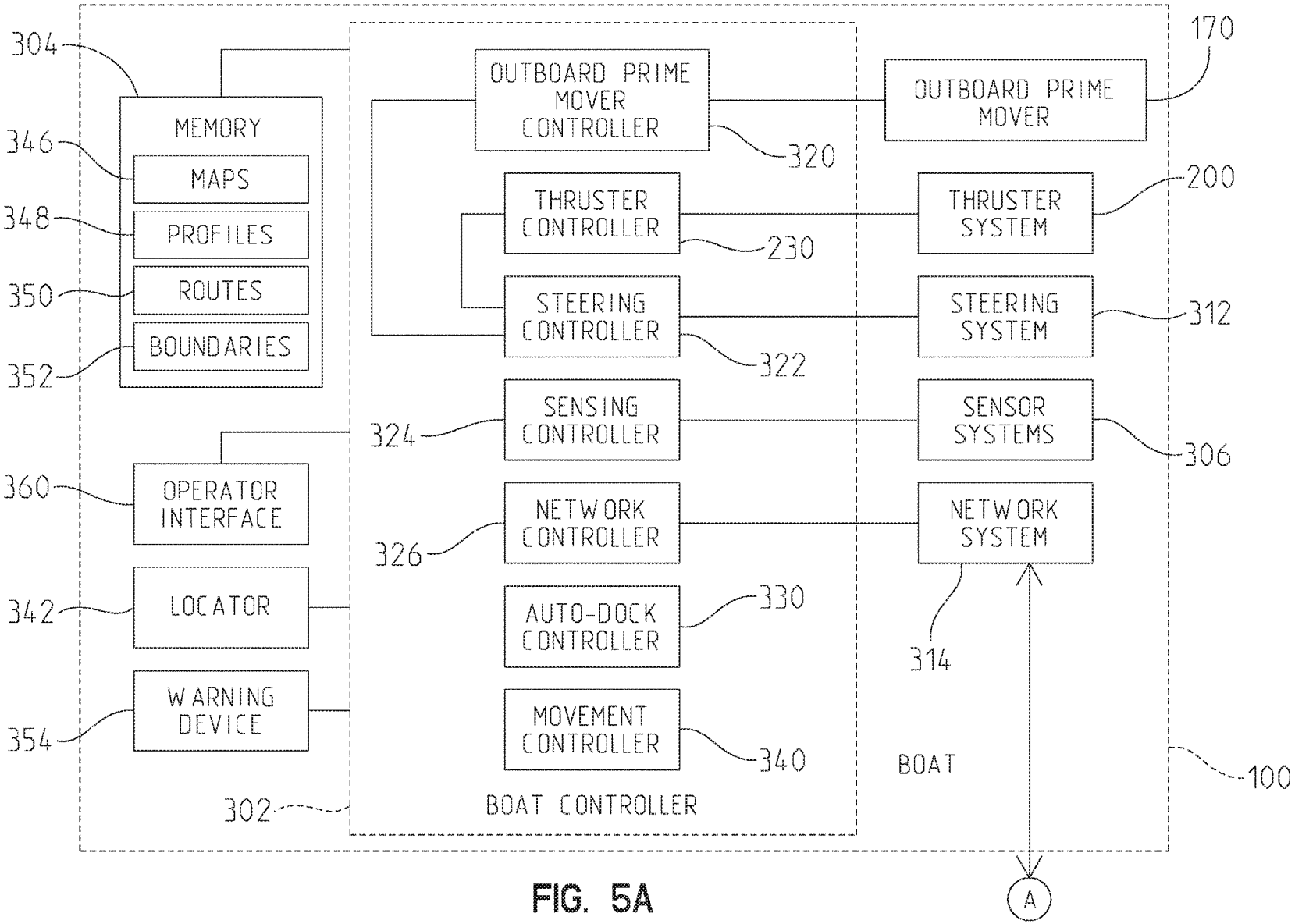
FIGS. 5A and 5B illustrate a representative view of the systems of the pontoon boat of FIG. 1 including a boat controller and an operator device.
Figure 5B:
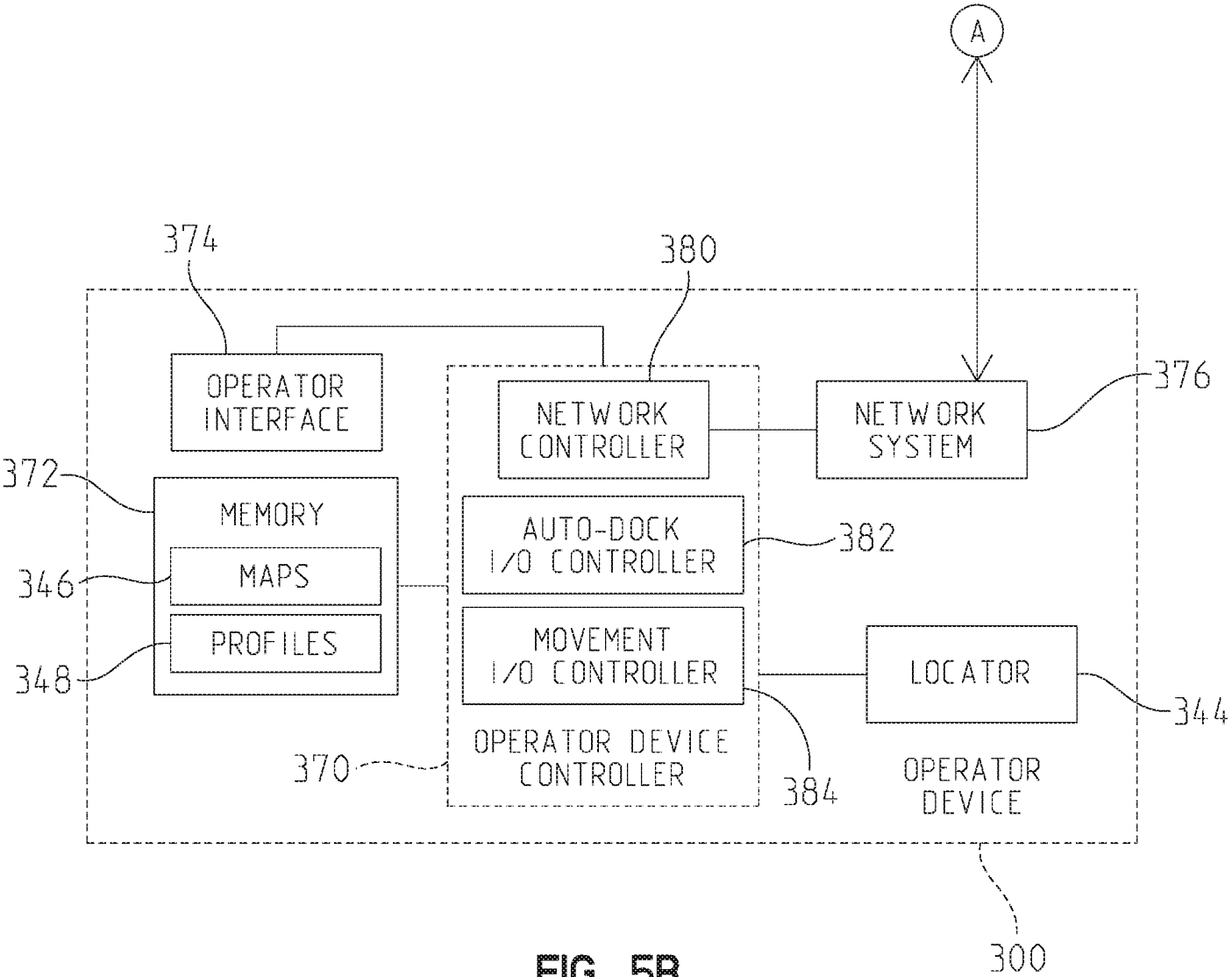

Referring to FIGS. 5A and 5B, systems of pontoon boat 100 and a remote operator device 300 are illustrated. Pontoon boat 100 includes a boat controller 302 having at least one associated memory 304. Memory 304 is one or more non-transitory computer readable mediums. Memory 304 may be representative of multiple memories which are provided locally with boat controller 302 or other available to boat controller 302 over a network. The information recorded or determined by boat controller 302 may be stored on memory 304.

Boat controller 302 provides the electronic control of the various components of pontoon boat 100. Further, boat controller 302 is operatively coupled to a plurality of sensors 306 which monitor various parameters of pontoon boat 100 or the environment surrounding pontoon boat 100. Boat controller 302 performs certain operations to control one or more subsystems of other boat components, such as one or more of sensor systems 306, an outboard prime mover system 308, thruster system 200, a steering system 312, a network system 314, and other systems. Boat controller 302 illustratively includes an outboard prime mover controller 320 which operates outboard prime mover system 308, thruster controller 230 which operates thruster system 200, a steering controller 322 which operates steering system 312, and a network controller 326 which operates network system 314. Outboard prime move system 308 and thruster system 200, if installed on pontoon boat 100, are collectively referred to herein as the propulsion system of pontoon boat 100. In certain embodiments, boat controller 302 forms a portion of a processing subsystem including one or more computing devices having memory, processing, and communication hardware. Boat controller 302 may be a single device or a distributed device, and the functions of boat controller 302 may be performed by hardware and/or as computer instructions on a non-transient computer readable storage medium, such as memory 304.

In embodiments, boat controller 302 further includes an auto-dock controller 330 which operates the systems of pontoon boat 100 to position pontoon boat 100 relative to a mooring implement, such as a dock, a slip, and a lift. Additional details regarding systems and methods related to the functionality of auto-dock controller 330 are provided in U.S. Provisional Patent Application Ser. No. 62/907,250, filed Sep. 27, 2019, ("Auto-Dock Provisional"), the entire disclosure of which is incorporated by reference herein.

Boat controller 302 further includes a movement controller 340 which controls the movement of boat 100 through the water, as described in more detail herein. Movement controller 340 controls the movement of boat 100 based on one or more of the sensed values received from sensor systems 306, one or more maps 346 stored in memory 304 (or memory 372 of operator device 300), one or more operator profiles 348 stored in memory 304 (or memory 372 of operator device 300), and location information from one or more of a locator 342 provided as part of boat 100, a component mounted to boat 100, such as a fish finder system, and a locator 344 associated with operator device 300. An exemplary locator 342 is a GPS receiver which provides global location information to boat controller 302.

In the illustrated embodiment of FIGS. 5A and 5B, boat controller 302 is represented as including several controllers, illustratively outboard prime mover controller 320, thruster controller 230, steering controller 322, sensing controller 324, network controller 326, auto-dock controller 330, and movement controller 340. These controllers may each be single devices or distributed devices or one or more of these controllers may together be part of a single device or distributed device. The functions of these controllers may be performed by hardware and/or as computer instructions on a non-transient computer readable storage medium, such as memory 304. Although outboard prime mover controller 320, thruster controller 230, steering controller 322, sensing controller 324, network controller 326, auto-dock controller 330, and movement controller are illustrated as discrete controllers, in embodiments, one or more of outboard prime mover controller 320, thruster controller 230, steering controller 322, sensing controller 324, network controller 326, auto-dock controller 330, and movement controller 340 may be part of the same controller.

In embodiments, boat controller 302 includes at least two separate controllers which communicate over a network. In one embodiment, the network is a CAN network. In one embodiment, the CAN network is implemented in accord with the J1939 protocol. Details regarding an exemplary CAN network are disclosed in U.S. patent application Ser. No. 11/218,163, filed Sep. 1, 2005, and published as US Published Patent Application No. US2007/0050095, the entire disclosure of which is expressly incorporated by reference herein. Of course, any suitable type of network or data bus may be used in place of the CAN network. In one embodiment, two wire serial communication is used.

Outboard prime mover system 308 includes a prime mover, illustratively outboard motor 170 in FIG. 2. Exemplary prime movers include outboard style motors, inboard style motors, internal combustion engines, two stroke internal combustion engines, four stroke internal combustion engines, diesel engines, electric motors, hybrid engines, jet powered engines, and other suitable sources of motive force. Outboard prime mover system 308 further includes a power supply system (not shown). The type of power supply system depends on the type of prime mover used. In embodiments, the prime mover is an internal combustion engine and the power supply system is one of a pull start system and an electric start system. Outboard prime mover system 308, in the case of an internal combustion engine, would further include a fuel system and air intake system which provide fuel and air to the internal combustion engine. In embodiments, the prime mover is an electric motor and power supply system is a switch system which electrically couples one or more batteries to the electric motor. In embodiments, the prime mover is a jet based engine which requires an auxiliary pump and/or water intake system.

Thruster system 200, as discussed herein and as disclosed in Thruster Provisional Application which is incorporated by reference herein, includes one or more thruster fluid pumps, valves, and other components.

Steering system 312 includes one or more devices which are controlled to alter a direction of travel of pontoon boat 100. In embodiments, steering system 312 includes a hydraulic system (not shown) which orients outboard motor 170 relative to deck 104. By turning outboard motor 170 relative to deck 104 a direction of travel of pontoon boat 100 may be altered. In embodiments, outboard motor 170 is stationary and pontoon boat 100 includes a separate rudder which is oriented by steering system 312 relative to deck 104 to steer pontoon boat 100. In embodiments, steering system 312 provides input to thruster system 200 to control operation of thruster system 200 to move and orient pontoon boat 100.

Sensor system 306 includes one or more sensing systems which provide input to boat controller 302 for operation of boat controller 302 and other sub-systems. Exemplary sensor systems for guiding the position of pontoon boat 100 include camera systems, stereo camera systems, location determiners such as GPS systems, accelerometers, magnetometers, gyroscopes, lidar systems, radar systems, ultrasound systems, piezo tubes, echo sounder, sonic pulse, acoustic Doppler, sonar, Inertial Measurement Units (IMUs), millimeter wave systems, and other suitable sensor systems to identify environmental objects such as docks, boats, buoys, water bottoms, fish, and other objects. In embodiments, stereo cameras 332 (see FIG. 2) are placed at the port-bow corner, the port-stern corner, the starboard-bow corner, the starboard-stern corner, and both longitudinal sides of pontoon boat 100. Exemplary sensors for sensor system 306 are provided in the Auto-Dock Provisional Application, which is expressly incorporated by reference herein.

Controller 302 further includes a network controller 326 which controls communication between pontoon boat 100 and remote devices through one or more network systems 314. In embodiments, network controller 326 of pontoon boat 100 communicates with remote devices over a wireless network. An exemplary wireless network is a radio frequency network utilizing a BLUETOOTH protocol or other wireless protocol. In this example, network system 314 includes a radio frequency antenna. Network controller 326 controls the communications between pontoon boat 100 and the remote devices. An exemplary remote device is remote operator device 300 described herein.

Boat controller 302 also interacts with an operator interface 360 which includes at least one input device and at least one output device. Exemplary input devices include levers, buttons, switches, soft keys, joysticks, and other suitable input devices. Exemplary output devices include lights, displays, audio devices, tactile devices, and other suitable output devices. In embodiments, the output devices include a display and boat controller 302 formats information to be displayed on the display and operator interface 360 displays the information. In one embodiment, input devices and output devices include a touch display and boat controller 302 formats information to be displayed on the touch display, operator interface 360 displays the information, and operator interface 360 monitors the touch display for operator input. Exemplary operator inputs include a touch, a drag, a swipe, a pinch, a spread, and other known types of gesturing.

Boat controller 302 may further receive input from or send output to remote operator device 300. Remote operator device 300 includes an operator device controller 370 with associated memory 372, an operator interface 374, a locator 344, and a network system 376. Exemplary remote operator device 300 include cellular phones, tablets, and other remote interfaces which may be handheld or mounted to pontoon boat 100. Exemplary cellular phones, include the IPHONE brand cellular phone sold by Apple Inc., located at 1 Infinite Loop, Cupertino, Calif. 95014 and the GALAXY brand cellular phone sold by Samsung Electronics Co., Ltd. Exemplary tablets in the IPAD brand tablet sold by Apple Inc.

Operator device controller 370 includes a network controller 380 which controls communication between remote operator device 300 and other devices, such as pontoon boat 100, through one or more network systems 314. In embodiments, network controller 380 of remote operator device 300 communicates with remote devices over a wireless network. An exemplary wireless network is a radio frequency network utilizing a BLUETOOTH protocol or other wireless protocol. In this example, network system 376 includes a radio frequency antenna. In embodiments, remote operator device 300 may be connected with pontoon boat 100 through a wired network.

Operator interface 374 includes at least one input device and at least one output device. Exemplary input devices include levers, buttons, switches, soft keys, and other suitable input devices. Exemplary output devices include lights, displays, audio devices, tactile devices, and other suitable output devices. In embodiments, the output devices include a display and operator device controller 370 formats information to be displayed on the display and operator interface 374 displays the information. In one embodiment, input devices and output devices include a touch display and operator device controller 370 formats information to be displayed on the touch display, operator interface 374 displays the information, and operator interface 374 monitors the touch display for operator input. Exemplary operator inputs include a touch, a drag, a swipe, a pinch, a spread, and other known types of gesturing.

Operator device controller 370 includes an auto-dock I/O controller 382. Auto-dock I/O controller 382 interacts with auto-dock controller 330 of pontoon boat 100 to operate the systems of pontoon boat 100 to position pontoon boat 100 relative to a dock, boat slip, sandbar/beach, buoy, lift, or other mooring implement as explained in more detail in the Auto-Dock Provisional which is incorporated by reference herein. Operator device controller 370 further includes a movement I/O controller 384 which interacts with movement controller 340 of pontoon boat 100 to operate the systems of pontoon boat 100 to move pontoon boat according to one or more of the exemplary processing sequences disclosed herein.

In the illustrated embodiment of FIGS. 5A and 5B, operator device controller 370 is represented as including several controllers, illustratively network controller 380, auto-dock I/O controller 382, and movement I/O controller 384. These controllers may each be single devices or distributed devices or one or more of these controllers may together be part of a single device or distributed device. The functions of these controllers may be performed by hardware and/or as computer instructions on a non-transient computer readable storage medium, such as memory 372 and/or memory 304. Although network controller 380, auto-dock I/O controller 382, and movement I/O controller 384 are illustrated as discrete controllers, in embodiments, network controller 380, auto-dock I/O controller 382, and movement I/O controller 384 may be part of the same controller.

Auto-dock I/O controller 382 and movement I/O controller 384 are illustrated as part of operator device controller 370. In embodiments, pontoon boat 100 includes a display as part of operator interface 360 and the functionality of one or both of auto-dock I/O controller 382 and movement I/O controller 384 is provided as part of boat controller 302.

Memory 304 includes one or more maps 346. Maps 346 may include contour maps of the water 10 on which pontoon boat 100 is floating. Maps 346 may provide a depth of the water at various locations of the water 10. Exemplary maps 346 are available from commercial map services, like the LAKEMASTER system from Humminbird, a Johnson Outdoors, Inc. company having an address of Johnson Outdoors Inc., 555 Main St., Racine Wis. 53403.

Memory 304 further includes one or more profiles 348. Exemplary profiles 348 include user profiles and boat profiles. In embodiments, boat controller 302 operates pontoon boat 100 based on a current profile or profiles associated with pontoon boat 100. For example, boat controller 302 controls the propulsion system based on a current profile or profiles associated with pontoon boat 100.

In embodiments, exemplary boat profiles provide information regarding the components installed on pontoon boat 100. For example, a boat profile may provide information on a level of the propulsion system of pontoon boat 100. Exemplary levels include a first level corresponding to the propulsion system having a single outboard motor 170, a second level corresponding to the propulsion system having multiple outboard motors 170, and a third level corresponding to the propulsion system having a single outboard motor 170 and a thruster system 200. The boat profile is editable so that as options are added to pontoon boat 100, the boat profile may be updated. Boat controller 302, based on the current boat profile, provides different level of controls to an operator of pontoon boat 100.

In embodiments, user profiles are communicated to boat controller 302 from remote operator device 300 when a user wants to operate pontoon boat 100. In embodiments, user profiles are stored on memory 304 and selected by boat controller 302 in response to a detection of an remote operator device 300 associated with a given profile. A user profile may include information regarding an identity of the user, specific boat settings for the user (e.g. seat positions, lighting, sound system, speed limits, and other suitable settings), one or more associated predefined routes 350, and one or more associated boundaries 352. Boat controller 302 is configured to operate pontoon boat 100 based on the current user profile associated with pontoon boat 100, such as controlling the propulsion system of pontoon boat 100 based on the current user profile.

Exemplary predefined routes 350 include routes across water 10 that have been stored for retrieval. The propulsion system of pontoon boat 100, outboard motor 170 and thruster system 200 and steering system 312, are controlled by boat controller 302 to follow a route 350 that has been selected. In embodiments, the routes 350 include routes from a first known point, such as a home dock, to a second known point, such as a restaurant adjacent the water 10. In embodiments, the routes 350 include relative routes that are to be followed from a current position of pontoon boat 100. Exemplary relative routes include routes defined based on the towing of one or more people with pontoon boat 100, such as water skiers or people who are tubing. Exemplary relative routes include a circle, a FIG. 8, a straight line, and other desired routes.

Exemplary boundaries 352 include regions of water 10 that the user associated with the identified profile 348 is not allowed to navigate pontoon boat 100. Exemplary boundaries 352 may be set by selecting at least two points through one of operator interface 360 of pontoon boat 100 and fluid conduit 274 of remote operator device 300. In embodiments, boundaries 352 are set by selecting points on a map 346 presented on a display of one of operator interface 360 of pontoon boat 100 and operator interface 374 of remote operator device 300.

Figure 6:
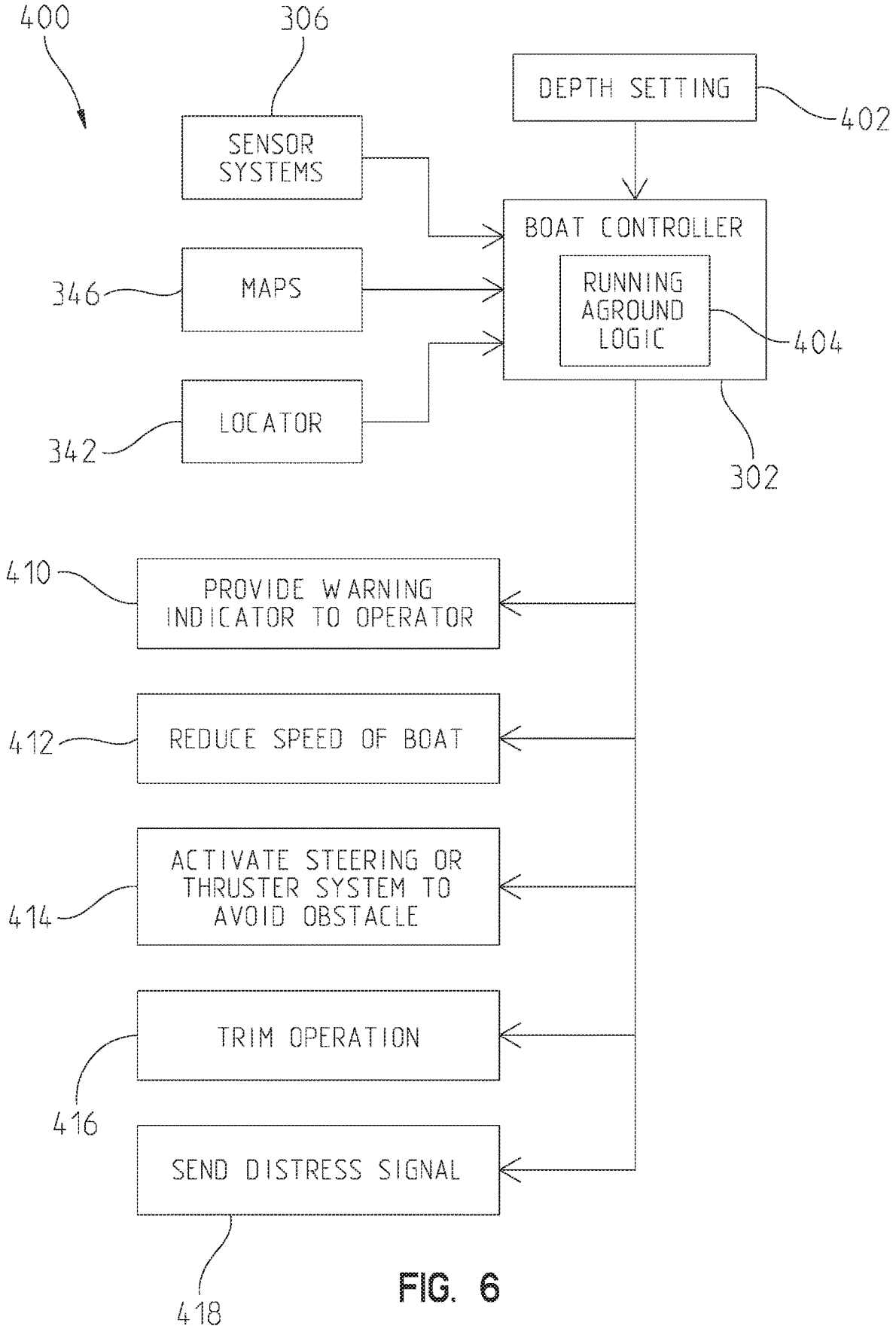
FIG. 6 illustrates an exemplary processing operation for the pontoon boat of FIG. 1.
Figure 6A:
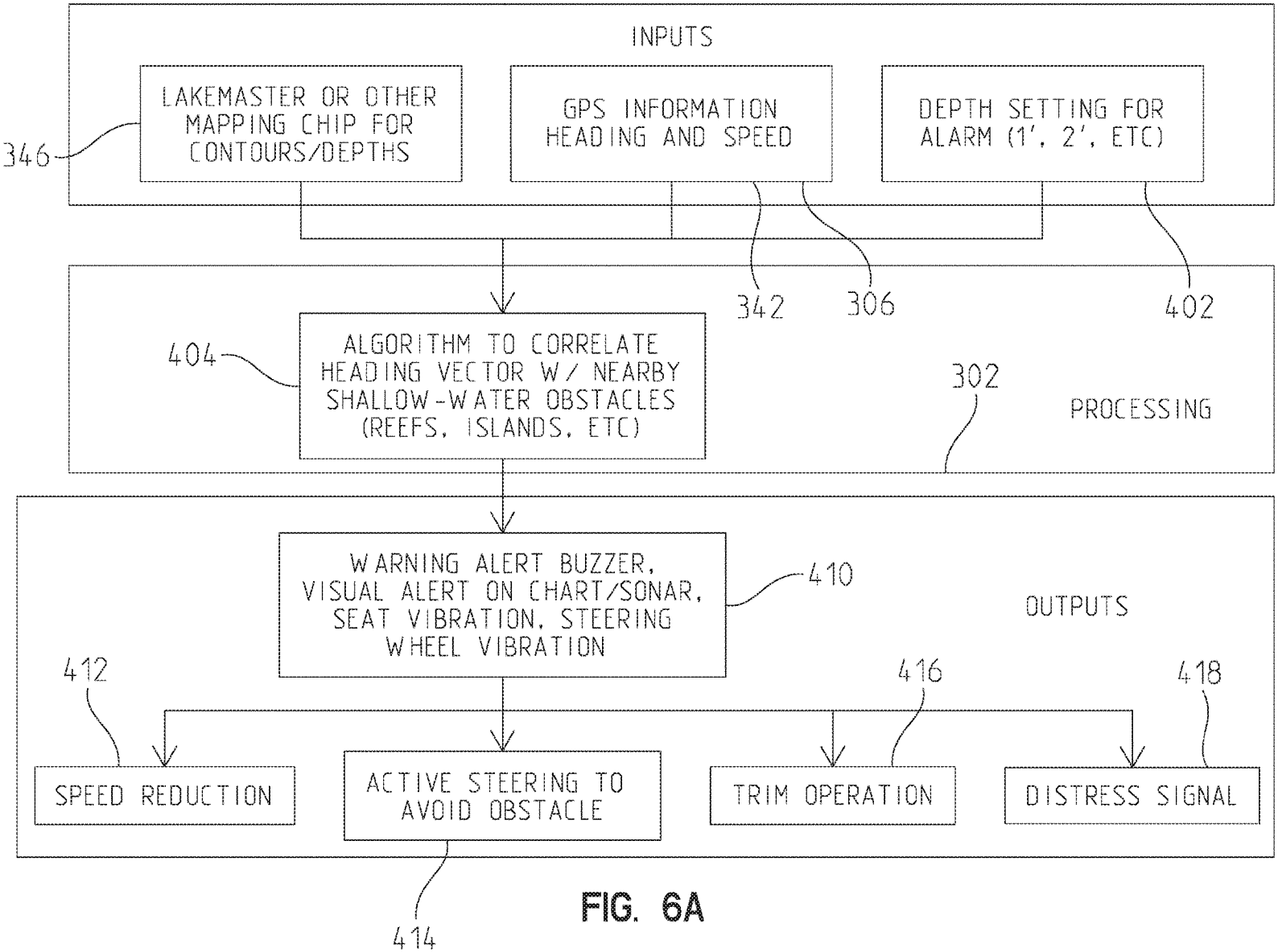
FIG. 6A illustrates the exemplary processing operation of FIG. 6.

Referring to FIGS. 6 and 6A, an exemplary operation 400 of boat controller 302 is illustrated. Operation 400 is an environmental obstacle avoidance operation executed by boat controller 302. In particular, operation 400 is an underwater obstacle avoidance operation executed by boat controller 302. An operator of pontoon boat 100 provides a depth setting 402 to boat controller 302. In embodiment, depth setting 402 is stored in a profile 348 associated with pontoon boat 100. The depth setting 402 corresponds to a depth of water 10 that, if pontoon boat 100 is positioned in, boat controller 302 should take action.

Boat controller 302 executes running aground logic 404 which receives information regarding the depth of water 10. In embodiments, exemplary information includes sensor information from sensor systems 306, such as a depth sensor. In embodiments, exemplary information includes a contour map 346 of water 10 and a location of pontoon boat 100 from locator 342.

Based on these inputs, running aground logic 404 of boat controller 302 compares an expected depth of the water 10 at an expected location of pontoon boat 100 to depth setting 402. The expected location of pontoon boat 100 corresponds to a future location of pontoon boat 100 based on the current heading and speed of pontoon boat 100. The look-ahead time window may be configurable in the current profile 348 associated with pontoon boat 100. If the depth of the water exceeds depth setting 402, pontoon boat 100 operates as normal. If the depth of the water falls below depth setting 402, boat controller 302 performs one or more actions.

Exemplary actions include providing a warning indicator to an operator of pontoon boat 100 with a warning device 354 (see FIG. 5A), as represented by block 410. Exemplary warning devices include audible warning devices, visual warning devices, and tactile warning device. Exemplary audible warning devices include a speaker, a horn, and other suitable devices which produce an audible sound. Exemplary visual warning devices include a display, lights, and other suitable devices which produce a visually perceptible effect. Exemplary tactile warning devices include a vibration device associated with a seat 114 of pontoon boat 100, a vibration device associated with remote operator device 300 connected to boat controller 302, and other suitable tactile devices.

Another exemplary action is to control the propulsion system of pontoon boat 100 to reduce a speed of pontoon boat 100, as represented by block 412. This allows more time for an operator to take action. A further exemplary action is to control one or both of steering system 312 and thruster system 200 to change a heading of pontoon boat 100 to avoid the possibility of pontoon boat 100 colliding with the underwater environmental object, such as the ground, as represented by block 414. Another exemplary action is to raise the trim position of outboard motor 170 to avoid outboard motor 170 colliding with the underwater environmental object, such as the ground, as represented by block 416. A further exemplary action is to provide a distress signal, as represented by block 418. In embodiments, the distress signal is communicated with a remote operator device 300 connected to pontoon boat 100.

In embodiments, running aground logic 404 may be deactivated by an operator input through operator interface 360 of pontoon boat 100 or operator interface 374 of remote operator device 300. By allowing running aground logic 404 to be deactivated, pontoon boat 100 may purposefully be navigated through water 10 having a depth less than depth setting 402.

Figure 7:
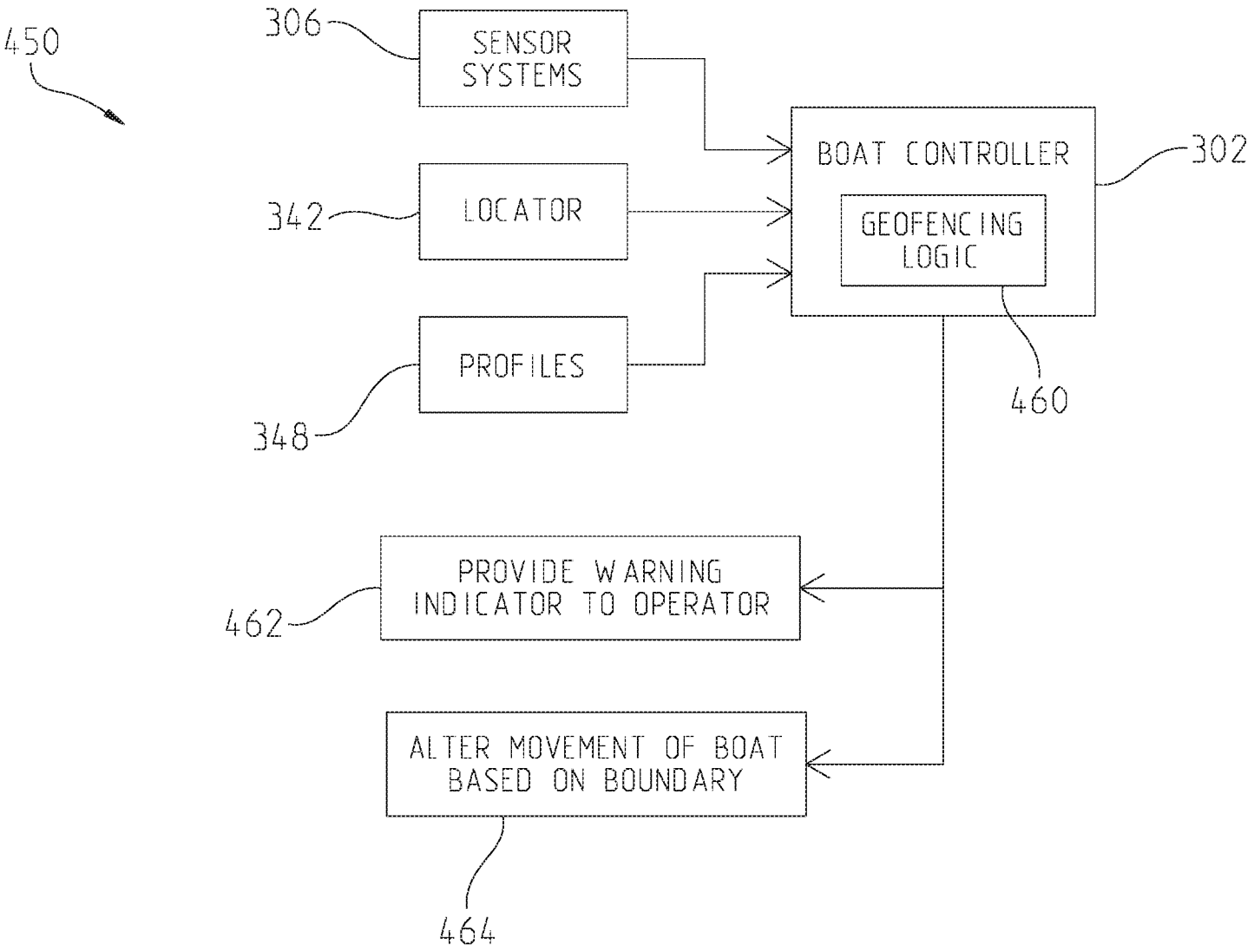
FIG. 7 illustrates an exemplary processing operation for the pontoon boat of FIG. 1.
Figure 8:
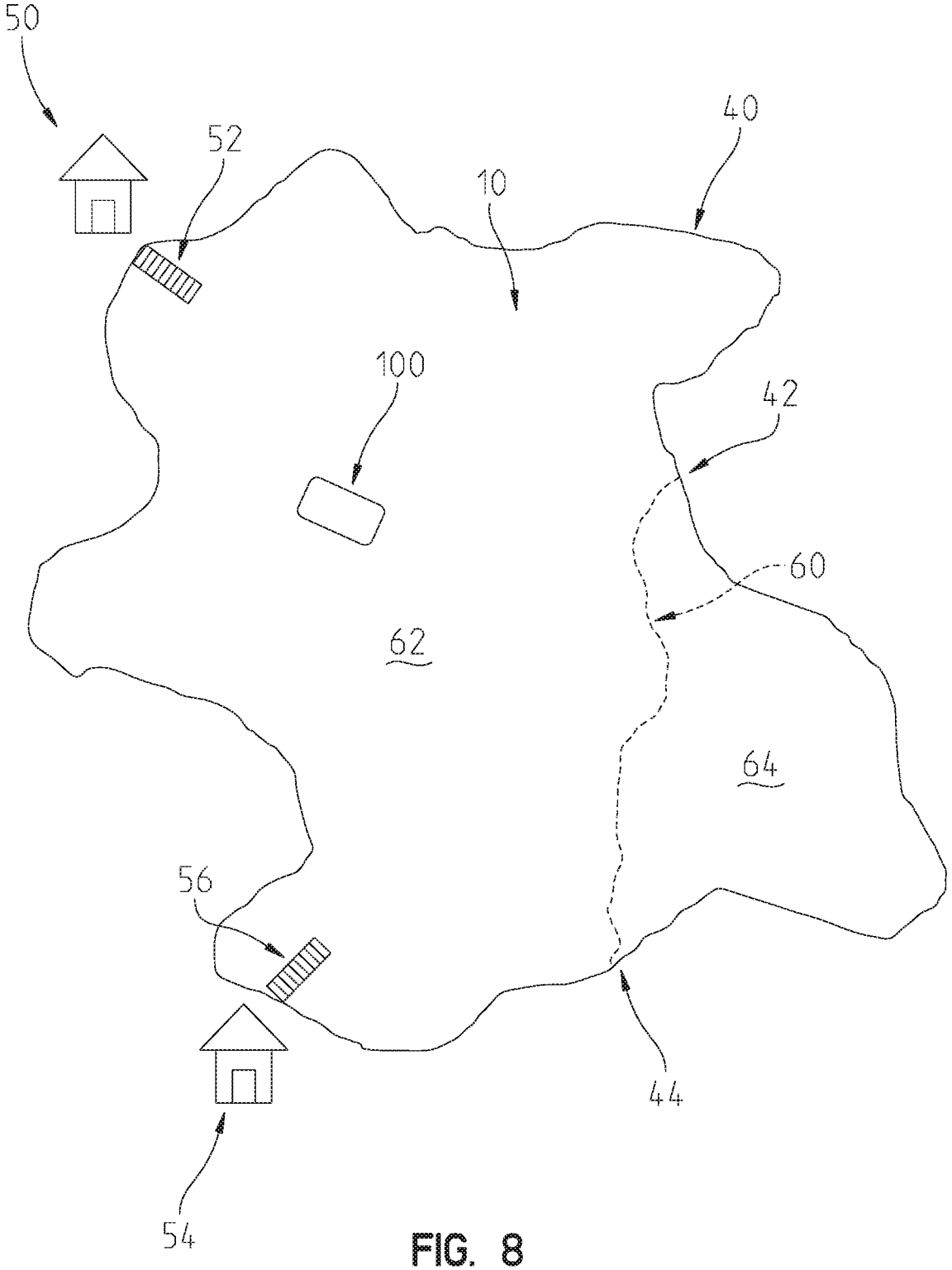
FIG. 8 illustrates an exemplary lake having a boundary defined for the pontoon boat of FIG. 1.

Referring to FIGS. 7 and 8, an exemplary operation 450 of boat controller 302 is illustrated. Operation 450 is a geofencing operation executed by boat controller 302. In particular, operation 450 at least one of warns an operator of pontoon boat 100 of impending entry into a restricted region of water 10 or actively prevents pontoon boat 100 from entering a restricted region of water 10 by control of at least one of steering system 312 and the propulsion system.

Referring to FIG. 8, an exemplary body of water 10, a lake, is illustrated. The body of water 10 has a coastline 40, a first location 50 proximate to coastline 40, and a second location 54 proximate to coastline 40. In the illustrated example, first location 50 is a home having an associated dock 52 and second location 54 is a restaurant having an associated dock 56. Pontoon boat 100 is shown maneuvering across the body of water 10.

A boundary 60 is represented extending from a first coast point 42 to a second coast point 44. Boundary 60 divides the body of water into a first side 62 and a second side 64. pontoon boat 100 is capable of navigating the body of water 10 on both first side 62 and second side 64 of boundary 60. In embodiments, boundary 60 is input through operator interface 374 of remote operator device 300 or operator interface 360 of pontoon boat 100. In an example, boundary 60 is input by drawing boundary 60 on a touch screen showing a map 346 of the body of water 10.

In embodiments, boundary 60 does not extend from a first coast point to a second coast point, but rather from any two points covering or proximate to the body of water 10. In embodiments, boundary 60 is a closed shape. In embodiments, boundary 60 is an open shape. In embodiments, multiple boundaries 60 are provided. Exemplary boundaries 354 may also be associated with the location of buoys, known shallow regions, known location of rocks, known location of fallen trees, and other regions. Further, boundaries 354 may be different for different user profiles.

Boat controller 302 executes geofencing logic 404 which determines if pontoon boat 100 approaches boundary 60 within a first distance, set in the boat profile 348, or if pontoon boat 100 is expected to reach boundary 60 within a first time period, set in the boat profile 348, based on a current heading and speed of pontoon boat 100.

Boat controller 302 receives information regarding the heading and speed of pontoon boat 100 from sensors 306 and the location of pontoon boat 100 from locator 342. Boat controller 302 further receives information from profiles 348 including the boundaries 352 corresponding to the current profile.

Based on these inputs, geofencing logic 460 of boat controller 302 determines if pontoon boat 100 approaches boundary 60 within a first distance, set in the boat profile 348, or if pontoon boat 100 is expected to reach boundary 60 within a first time period, set in the boat profile 348, based on a current heading and speed of pontoon boat 100. If pontoon boat 100 is not within a first distance of boundary 60 and pontoon boat 100 is not expected to reach boundary 60 within a first time period, then no action is taken. If pontoon boat 100 is within a first distance of boundary 60 or pontoon boat 100 is expected to reach boundary 60 within a first time period, then boat controller 302 performs one or more actions.

Exemplary actions include providing a warning indicator to an operator of pontoon boat 100 with a warning device 354 (see FIG. 5A), as represented by block 462. Exemplary warning devices include audible warning devices, visual warning devices, and tactile warning device. Exemplary audible warning devices include a speaker, a horn, and other suitable devices which produce an audible sound. Exemplary visual warning devices include a display, lights, and other suitable devices which produce a visually perceptible effect. Exemplary tactile warning devices include a vibration device associated with a seat 114 of pontoon boat 100, a vibration device associated with remote operator device 300 connected to boat controller 302, and other suitable tactile devices. Another exemplary action is to control the propulsion system of pontoon boat 100 and to control one or both of steering system 312 and thruster system 200 to change a heading of pontoon boat 100 to avoid the possibility of pontoon boat 100 crossing boundary 60.

Figure 9:
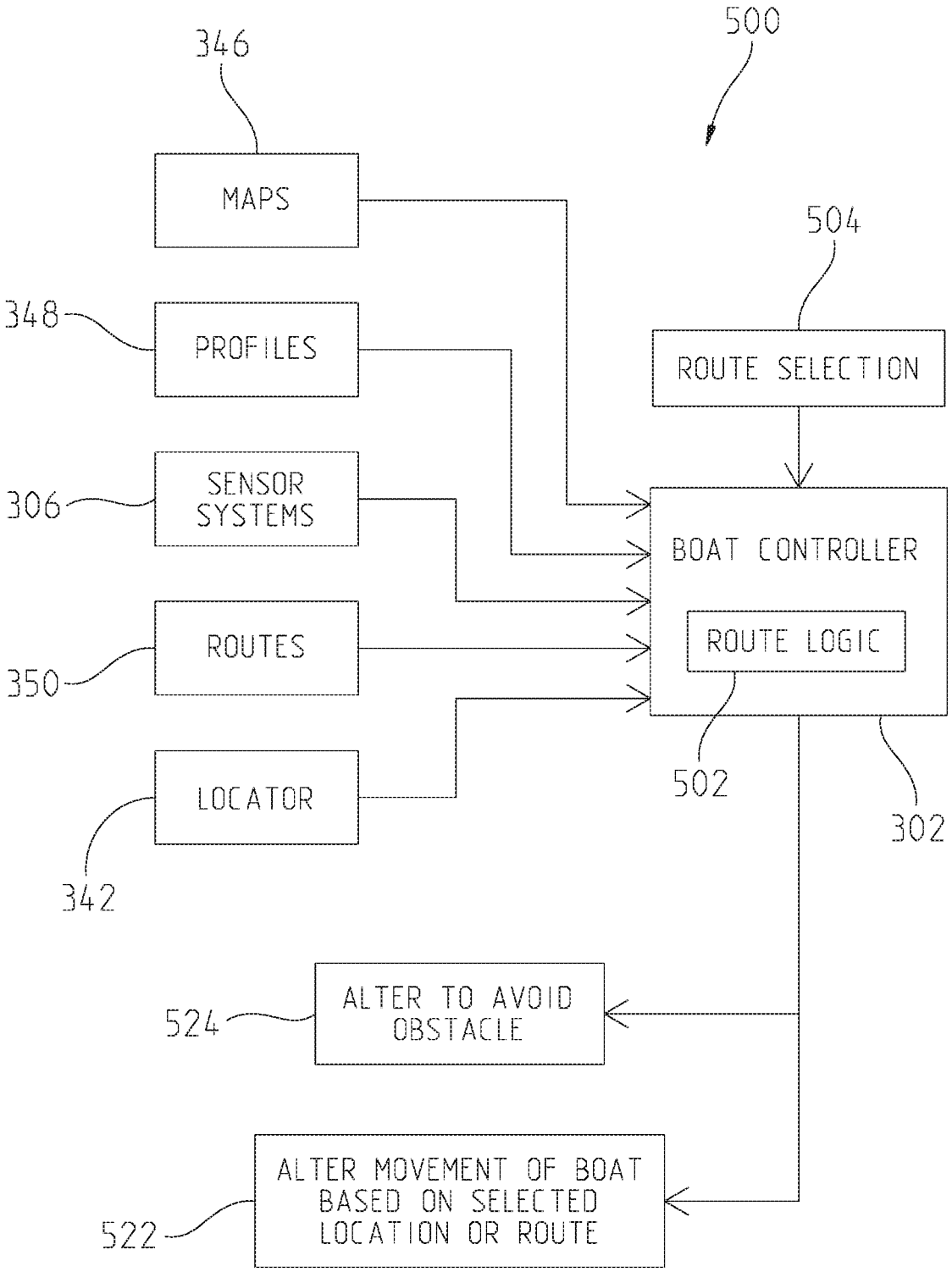
FIG. 9 illustrates an exemplary processing operation for the pontoon boat of FIG. 1.
Figure 10:
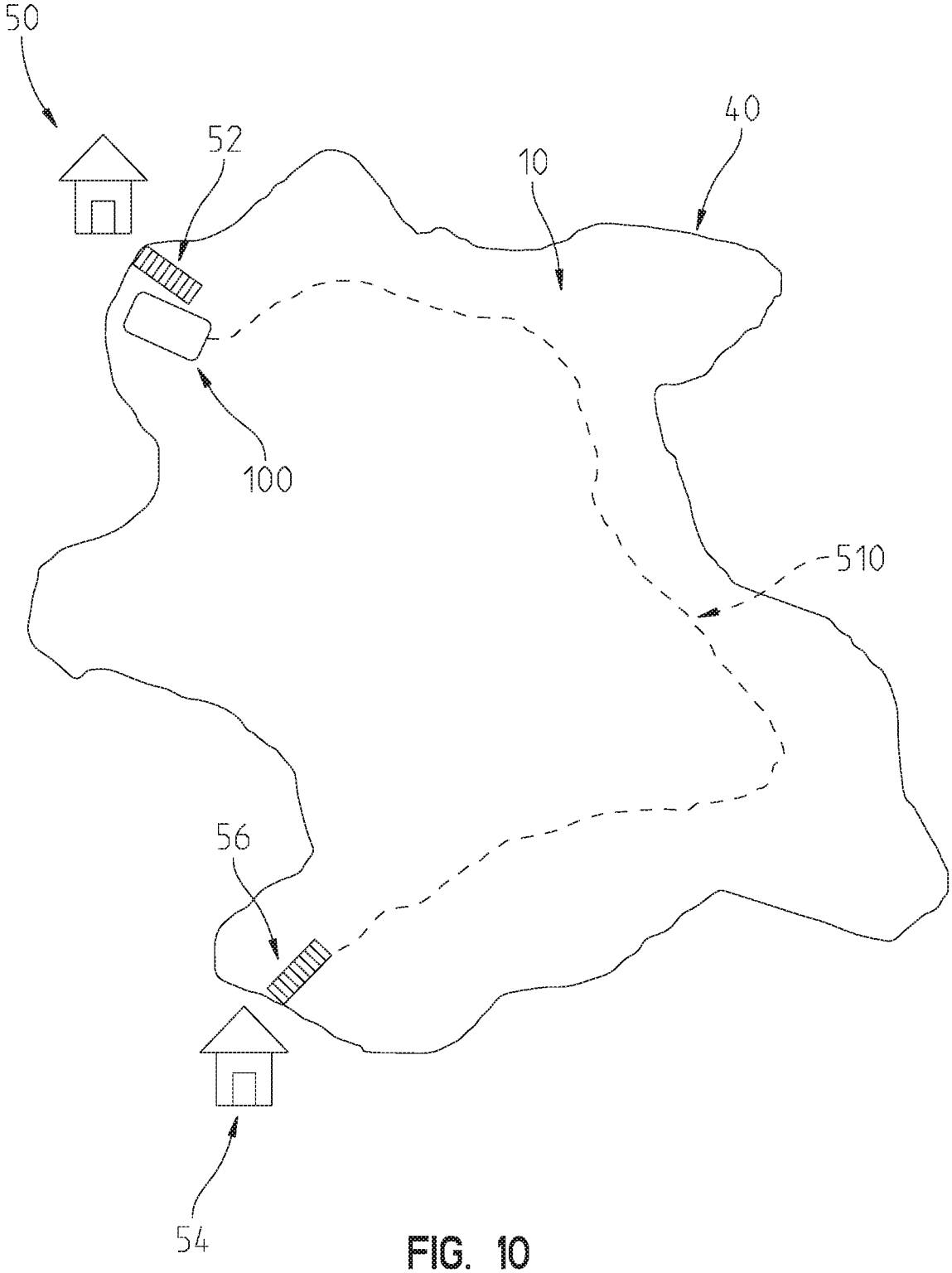
FIG. 10 illustrates an exemplary lake having a route defined for the pontoon boat of FIG. 1.

Referring to FIGS. 9 and 10, an exemplary operation 500 of boat controller 302 is illustrated. Operation 500 is a route operation executed by boat controller 302. In particular, operation 500 by control of at least one of steering system 312 and the propulsion system performs at least one of altering a speed and heading of pontoon boat 100 to maintain pontoon boat 100 on a selected route 350 through the body of water 10 and altering at least one of a speed and heading of pontoon boat 100 to avoid an environmental obstacle.

Referring to FIG. 10, an exemplary body of water 10, a lake, is illustrated. The body of water 10 has a coastline 40, a first location 50 proximate to coastline 40, and a second location 54 proximate to coastline 40. In the illustrated example, first location 50 is a home having an associated dock 52 and second location 54 is a restaurant having an associated dock 56. Pontoon boat 100 is shown preparing to leave dock 52 and follow a predefined route 510 through the body of water 10.

Predefined route 510 is a predefined route 350 stored in memory 304. As mentioned herein, predefined route 510 may be associated with a user profile 348. Exemplary routes 350 include a circular route around the body of water, a route to restaurant 54, a route to home dock 52, a route to a point of interest, and additional exemplary routes. If pontoon boat 100 is maneuvering according to predefined routes 350, an operator of pontoon boat 100 is free to not be in the driver seat of pontoon boat 100 continuously.

In embodiments, routes 350 include routes having a defined first end location and a defined second end location. In one example, wherein an end of a route 350 is proximate a dock 52, 56, when either the first end location or the second end location is reached, boat controller 302 executes an auto-dock operation with auto-dock controller 330. Additional details regarding auto-docking is disclosed in the Auto-Dock Provisional Application which is expressly incorporated by reference herein. Further, pontoon boat 100 does not need to start on one of the first end location or second end location to execute a route logic of boat controller 302. Rather, once a route is selected, boat controller 302 navigates pontoon boat 100 to the closest point along the selected route and then follows the route.

In embodiments, routes 350 are relative routes which define a movement of pontoon boat 100 from its current location. Exemplary relative routes include a circle, a FIG. 8, a straight line, and other desired routes.

Boat controller 302 executes route logic 502 which receives a selected route 504 from an operator through operator interface 360 of pontoon boat 100 or network system 376 of remote operator device 300. In embodiments, the selected route 504 may have been previously stored on memory 304 of pontoon boat 100 or memory 372 of remote operator device 300 or defined by an operator on the fly through operator interface 360 of pontoon boat 100 or network system 376 of remote operator device 300. Route logic 502 further receives information from locator 342, sensors 306, predefined routes 350, and operator profiles 348.

Based on these inputs, route logic 502 of boat controller 302 controls the propulsion system of pontoon boat 100 to alter one or more of a speed and heading of pontoon boat 100 based on the selected route 504, as represented by block 522. Further, route logic 502 controls the propulsion system of pontoon boat 100 to avoid any environmental obstacles detected by sensors 306 or provided by maps 346, as represented by block 522.

Figure 11:
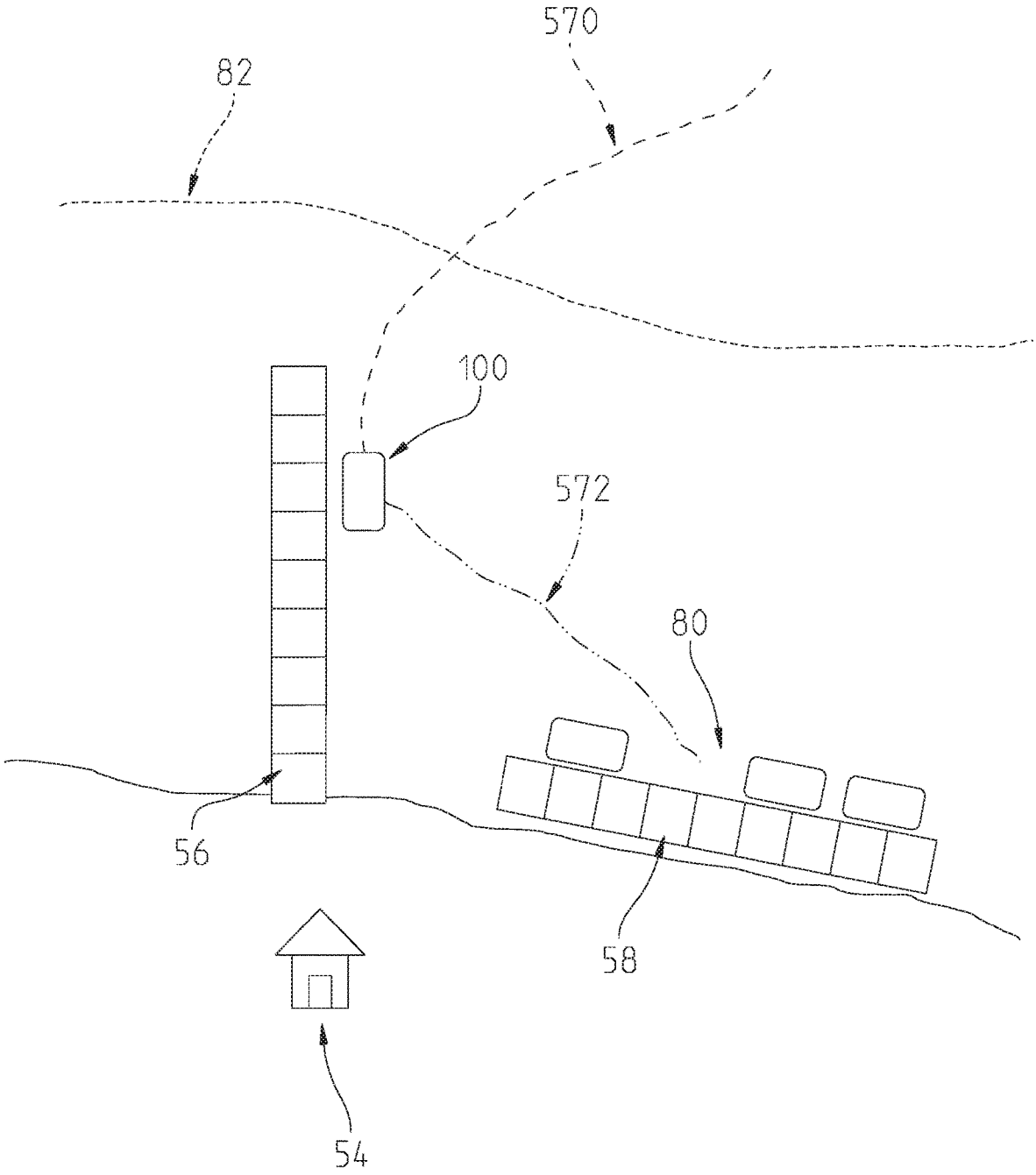
FIG. 11 illustrates an exemplary lake having a plurality of routes defined for the pontoon boat of FIG. 1.

Referring to FIG. 11, pontoon boat 100 is shown approaching main dock 56 of restaurant 54 along route 570. The operator of pontoon boat 100 may temporarily dock pontoon boat 100 at the main dock 56 and turn pontoon boat 100 over to a valet operator. The valet operator is able to operate pontoon boat 100 according to a valet profile 348 stored in memory 304 of pontoon boat 100. The valet profile becomes the current profile of pontoon boat 100 whenever the operator of pontoon boat 100 selects the valet profile through operator interface 360 of pontoon boat 100 or operator interface 374 of remote operator device 300.

The valet operator may then move pontoon boat 100 away from dock 56 to a parking dock 58 along route 572. The valet operator may select the auto-dock operation of boat controller 302 through operator interface 360 of pontoon boat 100 or operator interface 374 of remote operator device 300. The auto-dock operation of boat controller 302 presents target docking location 80 to the valet operator and receives confirmation of acceptance of the target docking location 80 from the valet operator through operator interface 360 of pontoon boat 100 or operator interface 374 of remote operator device 300. In embodiments, the valet profile includes a boundary 82 which warns or prevents the valet operator from moving pontoon boat 100 away from the area adjacent dock 56 and parking dock 58.

In embodiments, the location of pontoon boat 100 at dock 56 is stored in memory 304 and when the operator is ready to leave the restaurant, the valet operator starts pontoon boat 100 and selects the location to return pontoon boat 100 to for handoff to the operator. In embodiments, if pontoon boat 100 has remote start and is releasably moored to dock 58, an operator of pontoon boat 100 can auto-summon pontoon boat 100 to return to the location of dock 56. Boat controller 302 would control pontoon boat 100 to avoid environmental obstacles.

Figure 12:
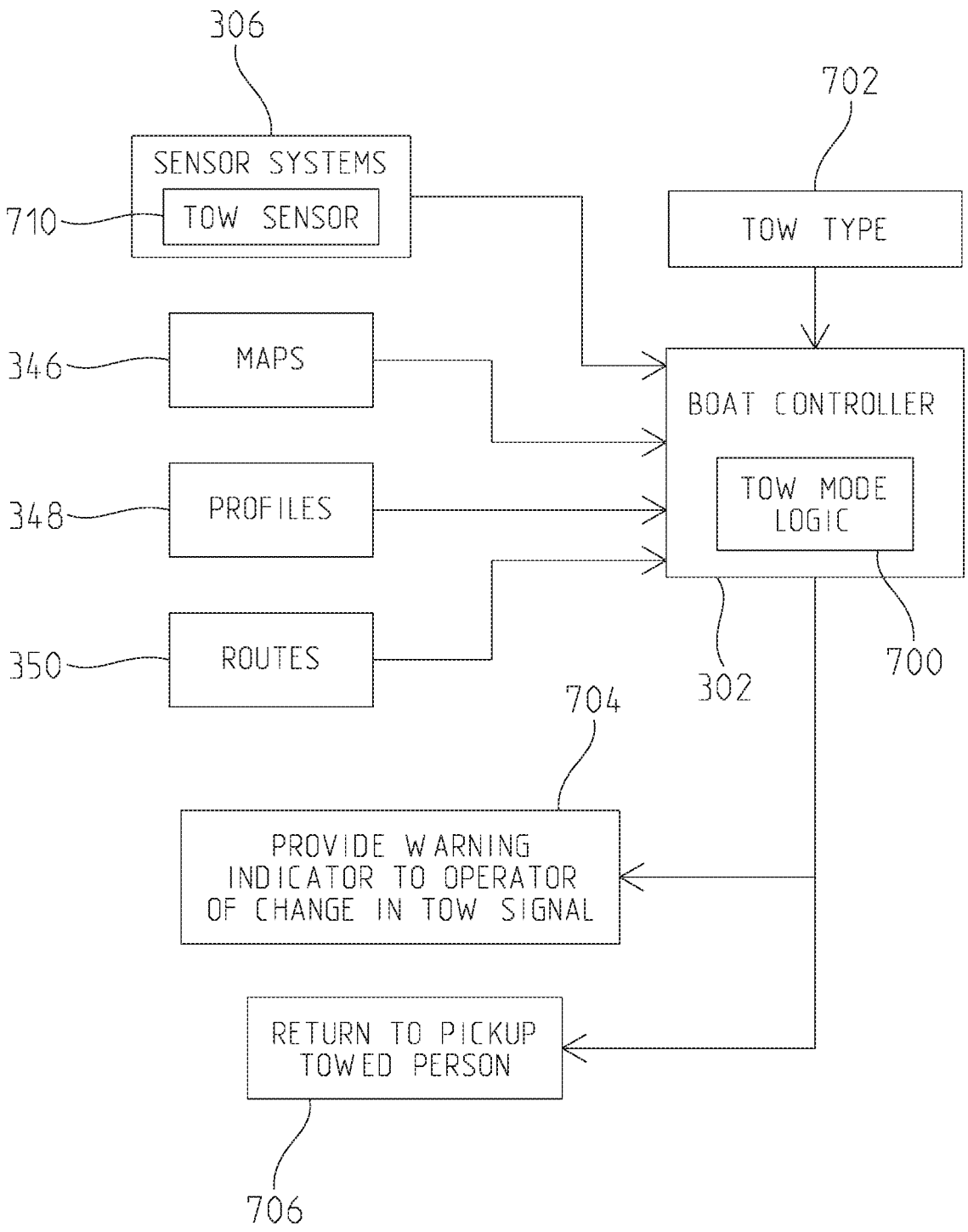
FIG. 12 illustrates an exemplary processing operation for the pontoon boat of FIG. 1.

Referring to FIG. 12, boat controller 302 executes a tow mode logic 700. Tow mode logic receives a towing type selection 702 from an operator of pontoon boat 100 through operator interface 360 of pontoon boat 100 or operator interface 374 of remote operator device 300. Tow mode logic 700, based on the tow type selected retrieves one or more routes 350 from memory 304. In embodiments, routes 350 are profile independent. In embodiments, routes 350 are profile specific. Exemplary routes 350 include relative routes for boat controller 302 to execute by controlling a speed and heading of pontoon boat 100 with the propulsion system and steering system 312.

In embodiments, sensors 306 includes a tow sensor 710 which senses a characteristic of a tow line (not shown). Exemplary tow sensors 710 include strain sensors which measure a level of tension on the tow line. When a tuber or water skier lets go of the tow line, the amount of tension changes. Based on this change in tension, tow mode logic 700 provides a warning to the operator of pontoon boat 100 that the skier or tuber has let go of the tow line and/or reduces a speed of pontoon boat 100. Further, if the skier or tuber is wearing a GPS device that is wirelessly connected to pontoon boat 100, boat controller 302 can control a speed and heading of pontoon boat 100 to return to the location of the skier or tuber in the water 10.

The illustrated embodiments are described with reference to pontoon boat 100. The scope of the described embodiments is not limited to the specific application of pontoon boats, but rather may be implemented on any type of aquatic vessels, including but not limited to pontoon boats, single hull boats, and other suitable aquatic vessels.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

We claim:

1. A pontoon boat comprising:

a plurality of pontoons;

a deck supported by the plurality of pontoons, the deck having an outer perimeter;

a plurality of sensors supported by the plurality of pontoons;

a propulsion system having at least one prime mover which propels the pontoon boat through a body of water; and at least one controller operatively coupled to the plurality of sensors and the at least one prime mover, the at least one controller configured to monitor a location of the pontoon boat and determine a relationship of the pontoon boat to a boundary in the body of water, wherein:

the boundary corresponds to a shape that is defined by at least a first point and a second point on a map that includes the body of water;

the pontoon boat is capable of navigating on both a first side of the boundary and a second side of the boundary; and the second side of the boundary opposite the first side of the boundary.

2. The pontoon boat of claim 1, wherein the at least one controller is further configured to control the propulsion system to maintain the pontoon boat on a first side of the boundary.

3. The pontoon boat of claim 1, further comprising:

at least one memory including a plurality of operator profiles, a first operator profile includes the boundary and a second operator profile does not include the boundary, wherein the at least one controller is further configured to determine which operator profile is currently associated with the pontoon boat and, if the second operator profile is associated with the pontoon boat, the at least one controller permits the pontoon boat to cross the boundary.

4. The pontoon boat of claim 1, further comprising a locator operatively coupled to the at least one controller, the locator providing an indication of the location of the pontoon boat to the at least one controller.

5. The pontoon boat of claim 1, wherein the plurality of sensors includes at least one sensor monitoring an above water region proximate the pontoon boat, wherein the at least one controller is operatively coupled to the at least one sensor to determine a position of an environmental object proximate the pontoon boat and to control the propulsion system to avoid contact with the environmental object.

6. The pontoon boat of claim 1, wherein the plurality of pontoons includes a port side pontoon, a starboard side pontoon, and a third pontoon positioned between the port side pontoon and the starboard side pontoon, each of the plurality of pontoons extending longitudinally under the deck.

7. The pontoon boat of claim 1, wherein the propulsion system includes an outboard motor positioned at a stern of the deck of the pontoon boat.

8. The pontoon boat of claim 1, wherein the propulsion system includes a thruster system including at least one water inlet in the plurality of pontoons and a plurality of water outlets in the plurality of pontoons.

9. The pontoon boat of claim 8, wherein the at least one water inlet and the plurality of water outlets are provided in a third pontoon that is positioned between a port side pontoon and a starboard side pontoon of the plurality of pontoons.

10. The pontoon boat of claim 8, wherein the plurality of water outlets includes at least two of a port-bow outlet, a port-stern outlet, a starboard-bow outlet, and a starboard-stern outlet.

11. The pontoon boat of claim 8, wherein the thruster system further includes at least one fluid pump which pumps fluid from the at least one inlet towards at least one of the plurality of outlets.

12. The pontoon boat of claim 1, further comprising a warning device operably coupled to the at least one controller, the at least one controller causing the warning device to announce a warning in response to the location of the pontoon boat approaching within a first distance of the boundary.

13. The pontoon boat of claim 12, wherein the warning device provides at least one of an audible warning, a visual warning, and a tactile warning.

14. A method of controlling a position of a pontoon boat relative to a boundary, the method comprising the steps of:

monitoring a location of the pontoon boat with at least one controller associated with the pontoon boat;

determining a relationship of the pontoon boat to a boundary in a body of water with the at least one controller associated with the pontoon boat, wherein:

the boundary corresponds to a shape that is defined by at least a first point and a second point on a map that includes the body of water; and the pontoon boat is capable of navigating on both a first side of the boundary and a second side of the boundary; and in response to the location of the pontoon boat approaching within a first distance of the boundary, with the at least one controller associated with the pontoon boat, providing a warning to an operator of the pontoon boat.

15. The method of claim 14, further comprising in response to the location of the pontoon boat approaching within the first distance of the boundary automatically controlling, with the at least one controller associated with the pontoon boat, the propulsion system to maintain the pontoon boat on the first side of the boundary.

16. The method of claim 15, wherein the step of automatically controlling, with the at least one controller associated with the pontoon boat, the propulsion system to maintain the pontoon boat on the first side of the boundary includes the step of altering the position of the pontoon boat with a thruster system carried by at least one of the plurality of pontoons.

17. The method of claim 14, further comprising the step of receiving a user input of at least two positions which influence at least a portion of the shape.

18. A method of controlling a position of a pontoon boat relative to a boundary, the method comprising the steps of:

monitoring a location of the pontoon boat with at least one controller associated with the pontoon boat;

determining a relationship of the pontoon boat to a boundary in the water with the at least one controller associated with the pontoon boat, the pontoon boat capable of navigating on both a first side of the boundary and a second side of the boundary; and in response to the location of the pontoon boat approaching within a first distance of the boundary automatically controlling, with the at least one controller associated with the pontoon boat, the propulsion system to maintain the pontoon boat on the first side of the boundary.

19. The method of claim 18, wherein the step of automatically controlling, with the at least one controller associated with the pontoon boat, the propulsion system to maintain the pontoon boat on the first side of the boundary includes the step of altering the position of the pontoon boat with a thruster system carried by at least one of the plurality of pontoons.

20. The method of claim 18, further comprising the step of receiving a user input of at least two positions which influence a shape of at least a portion of the boundary.

21. A pontoon boat for navigating through water having a plurality of environmental objects, the pontoon boat comprising:

a plurality of pontoons;

a deck supported by the plurality of pontoons, the deck having an outer perimeter;

a plurality of sensors supported by the plurality of pontoons;

a propulsion system having at least one prime mover which propels the pontoon boat through the water; and at least one controller operatively coupled to the plurality of sensors and the at least one prime mover, the at least one controller configured to monitor a location of the pontoon boat and to determine a relationship of the pontoon boat to a location of a first environmental object of the plurality of environmental objects in the water, and automatically controlling the propulsion system to avoid the first environmental object, the first environmental object being an underwater environmental object.

22. The pontoon boat of claim 21, wherein the location of the first environmental object is determined by the at least one controller from a map of the water.

23. The pontoon boat of claim 21, wherein the location of the first environmental object is determined by the at least one controller based on an output from at least one sensor of the plurality of sensors.

24. The pontoon boat of claim 21, further comprising a locator operatively coupled to the at least one controller, the locator providing an indication of the location of the pontoon boat to the at least one controller.

25. The pontoon boat of claim 21, wherein the plurality of sensors includes at least one sensor monitoring an above water region proximate the pontoon boat, wherein the at least one controller is operatively coupled to the at least one sensor to determine a position of a second environmental object of the plurality of environmental objects proximate the pontoon boat and to control the propulsion system to avoid contact with the second environmental object of the plurality of environmental objects.

26. The pontoon boat of claim 21, wherein the plurality of pontoons includes a port side pontoon, a starboard side pontoon, and a third pontoon positioned between the port side pontoon and the starboard side pontoon, each of the plurality of pontoons extending longitudinally under the deck.

27. The pontoon boat of claim 21, wherein the propulsion system includes an outboard motor positioned at a stern of the deck of the pontoon boat.

28. The pontoon boat of claim 21, wherein the propulsion system includes a thruster system including at least one water inlet in the plurality of pontoons and a plurality of water outlets in the plurality of pontoons.

29. The pontoon boat of claim 28, wherein the at least one water inlet and the plurality of water outlets are provided in the third pontoon.

30. The pontoon boat of claim 28, wherein the plurality of water outlets includes at least two of a port-bow outlet, a port-stern outlet, a starboard-bow outlet, and a starboard-stern outlet.

31. The pontoon boat of claim 28, wherein the thruster system further includes at least one fluid pump which pumps fluid from the at least one inlet towards at least one of the plurality of outlets.

32. The pontoon boat of claim 21, further comprising a warning device operably coupled to the at least one controller, the at least one controller causing the warning device to announce a warning in response to the location of the pontoon boat approaching within a first distance of the first environmental object.

33. The pontoon boat of claim 32, wherein the warning device provides at least one of an audible warning, a visual warning, and a tactile warning.

34. A pontoon boat for navigating through water having a plurality of environmental objects, the pontoon boat comprising:

a plurality of pontoons;

a deck supported by the plurality of pontoons, the deck having an outer perimeter;

a propulsion system having at least one prime mover which propels the pontoon boat through the water;

at least one controller operatively coupled to the at least one prime mover; and a memory accessible by the at least one controller, the memory including a current profile associated with the pontoon boat, the at least one controller configured to operate the pontoon boat based on the current profile associated with the pontoon boat.

35. The pontoon boat of claim 34, wherein the at least one controller controls the propulsion system based on the current profile associated with the pontoon boat.

36. The pontoon boat of claim 34, wherein the current profile limits the pontoon boat from crossing a boundary in the water, the pontoon boat capable of navigating on both a first side of the boundary and a second side of the boundary, the second side of the boundary opposite the first side of the boundary.

37. The pontoon boat of claim 34, wherein the current profile is a user profile.

38. The pontoon boat of claim 37, wherein the current profile is selected from a plurality of profiles stored on the memory.

39. The pontoon boat of claim 37, wherein the current profile is communicated to the pontoon boat from a portable operator device.

40. The pontoon boat of claim 37, wherein the current profile is a valet profile and the controller is configured to automatically dock the pontoon boat when the current profile is a valet profile.

41. The pontoon boat of claim 34, wherein the current profile is a boat profile, the boat profile specifying a level of the propulsion system.

42. The pontoon boat of claim 41, wherein a first level of the propulsion system includes a single outboard motor.

43. The pontoon boat of claim 42, wherein a second level of the propulsion system includes multiple outboard motors.

44. The pontoon boat of claim 41, wherein a third level of the propulsion systems includes a thruster system including at least one water inlet in the plurality of pontoons and a plurality of water outlets in the plurality of pontoons.

45. A pontoon boat comprising:

a plurality of pontoons;

a deck supported by the plurality of pontoons, the deck having an outer perimeter;

a plurality of sensors supported by the plurality of pontoons;

a propulsion system having at least one prime mover which propels the pontoon boat through the water, the at least one prime mover including a thruster system including at least one water inlet in the plurality of pontoons, a plurality of water outlets in the plurality of pontoons, and at least one fluid pump which pumps fluid from the at least one inlet towards at least one of the plurality of outlets;

at least one controller operatively coupled to the plurality of sensors and the at least one prime mover; and a memory accessible by the at least one controller and at least one stored predefined route for the pontoon boat, the at least one controller configured to monitor a location of the pontoon boat and to move the pontoon boat according to the predefined route stored on the memory.

46. The pontoon boat of claim 45, wherein the plurality of sensors includes at least one sensor monitoring an above water region proximate the pontoon boat, wherein the at least one controller is operatively coupled to the at least one sensor to determine a position of an environmental object proximate the pontoon boat and to control the propulsion system to avoid contact with the environmental object.

47. The pontoon boat of claim 45, wherein the plurality of pontoons includes a port side pontoon, a starboard side pontoon, and a third pontoon positioned between the port side pontoon and the starboard side pontoon, each of the plurality of pontoons extending longitudinally under the deck, wherein the at least one water inlet and the plurality of water outlets are provided in the third pontoon.

48. The pontoon boat of claim 45, wherein the plurality of water outlets includes at least two of a port-bow outlet, a port-stern outlet, a starboard-bow outlet, and a starboard-stern outlet.

49. The pontoon boat of claim 45, wherein the plurality of sensors includes a tow sensor which provides an indication of a characteristic of a tow line.

50. A pontoon boat comprising:

a plurality of pontoons extending longitudinally under the deck, comprising a port side pontoon, a starboard side pontoon, and a third pontoon positioned between the port side pontoon and the starboard side pontoon;

a deck supported by the plurality of pontoons, the deck having an outer perimeter;

a plurality of sensors supported by the plurality of pontoons;

a propulsion system comprising:

at least one prime mover that propels the pontoon boat through the water; and a thruster system including at least one water inlet and a plurality of water outlets that are provided in the third pontoon; and at least one controller operatively coupled to the plurality of sensors and the at least one prime mover, the at least one controller configured to monitor a location of the pontoon boat and determine a relationship of the pontoon boat to a boundary in the water, the pontoon boat capable of navigating on both a first side of the boundary and a second side of the boundary, the second side of the boundary opposite the first side of the boundary.

51. A method of controlling a position of a pontoon boat relative to a boundary, the method comprising the steps of:

receiving a user input of at least two positions that influence a shape of at least a portion of a boundary in the water;

monitoring, with at least one controller associated with the pontoon boat, a location of the pontoon boat;

determining, with the at least one controller associated with the pontoon boat, a relationship of the pontoon boat to the boundary, the pontoon boat capable of navigating on both a first side of the boundary and a second side of the boundary; and in response to the location of the pontoon boat approaching within a first distance of the boundary, providing, with the at least one controller associated with the pontoon boat, a warning to an operator of the pontoon boat.

* * * * *